US007462035B2

(12) United States Patent
Lee et al.

(10) Patent No.: US 7,462,035 B2
(45) Date of Patent: Dec. 9, 2008

(54) ELECTRICAL CONNECTOR CONFIGURED AS A FASTENING ELEMENT

(75) Inventors: Kang Lee, Woodland Hills, CA (US); Thomas Forrester, Westminster, CA (US); Tomasz Jannson, Torrance, CA (US); Andrew Kostrzewski, Garden Grove, CA (US); Eugene Levin, Los Angeles, CA (US); Gajendra Savant, Rolling Hills Estates, CA (US)

(73) Assignee: Physical Optics Corporation, Torrance, CA (US)

( * ) Notice: Subject to any disclaimer, the term of this patent is extended or adjusted under 35 U.S.C. 154(b) by 0 days.

(21) Appl. No.: 11/190,697

(22) Filed: Jul. 27, 2005

(65) Prior Publication Data

US 2007/0026695 A1 Feb. 1, 2007

(51) Int. Cl.
*H01R 33/00* (2006.01)

(52) U.S. Cl. ..... 439/37; 439/121

(58) Field of Classification Search ..... 439/37, 439/121

See application file for complete search history.

(56) References Cited

U.S. PATENT DOCUMENTS

| | | | | |
|---|---|---|---|---|
| 2,021,111 | A | | 11/1935 | Wheat |
| 2,824,290 | A | * | 2/1958 | Archer et al. ..... 439/294 |
| 3,521,216 | A | * | 7/1970 | Tolegian ..... 439/39 |
| 4,087,297 | A | | 5/1978 | Johnson |
| 4,308,572 | A | | 12/1981 | Davidson et al. |
| 4,480,293 | A | | 10/1984 | Wells |
| 4,570,206 | A | | 2/1986 | Deutsch |
| 4,602,191 | A | | 7/1986 | Davila |
| 4,728,751 | A | | 3/1988 | Canestaro et al. |
| 4,752,351 | A | | 6/1988 | Lunt |
| 4,774,434 | A | | 9/1988 | Bennion |
| 4,785,136 | A | | 11/1988 | Mollet et al. |
| 4,975,317 | A | | 12/1990 | Kuhn et al. |
| 5,375,044 | A | | 12/1994 | Guritz |
| 5,455,749 | A | | 10/1995 | Ferber |

(Continued)

FOREIGN PATENT DOCUMENTS

| | | |
|---|---|---|
| WO | WO0136728 | 5/2001 |

(Continued)

*Primary Examiner*—James Harvey
(74) *Attorney, Agent, or Firm*—Sheppard Mullin Richter & Hampton LLP

(57) ABSTRACT

An entirely wearable electrical connector for power/data connectivity. The principal element of a modular network is the wearable electrical connector, which is integrated into a personal area network with USB compatibility. Several wearable connector embodiments are disclosed. The first, an O-ring based version, was subsequently replaced by a more mature second version, which is based on anisotropic pressure sensitive conductive elastomer. Both are snap-style, low-profile, 360°-moving, round, blind operable plug-and-play, reconfigurable wearable connectors with power/data daisy-lattice-style connectivity. A third embodiment comprises a non-conductive elastomeric environmental seal. A fourth embodiment utilizes a self-acting, automatic shutter-type environmental seal. A fifth embodiment comprises a smaller version that resembles a conventional snap fastener commonly used on clothing. The inventive technology will benefit the military and public safety personnel such as police, fire, EMT and other services that require special protective clothing integrated with multiple electronic devices. Other applications include special clothing for the disabled, prisoners, the mentally ill and children. A non-wearable embodiment is used to provide evidence of tampering of a container.

25 Claims, 35 Drawing Sheets

U.S. PATENT DOCUMENTS 5,497,140 A 3/1996 Tuttle
5,551,882 A * 9/1996 Whiteman et al. ..... 439/21
5,586,668 A * 12/1996 Miller ..... 213/1.3
5,704,792 A * 1/1998 Sobhani ..... 439/21
5,785,181 A 7/1998 Quartararo
5,986,562 A 11/1999 Nikolich
6,013,346 A 1/2000 Lewis et al.
6,080,690 A 6/2000 Lebby et al.
6,243,870 B1 * 6/2001 Graber ..... 2/69
6,324,053 B1 * 11/2001 Kamijo ..... 361/683
6,350,129 B1 2/2002 Gorlick
6,381,482 B1 4/2002 Jayaraman et al.
6,412,701 B1 7/2002 Kohama et al.
6,420,008 B1 7/2002 Lewis et al.
6,727,197 B1 4/2004 Wilson et al.
6,729,025 B2 5/2004 Farrell et al.
6,767,218 B2 7/2004 Marmaropoulos
6,805,568 B2 * 10/2004 Kuzmenka ..... 439/285
6,895,261 B1 * 5/2005 Palamides ..... 455/575.6
6,939,142 B2 * 9/2005 Maruyama et al. ..... 439/66
7,151,455 B2 * 12/2006 Lindsay et al. ..... 340/572.3
7,344,379 B2 * 3/2008 Marmaropoulos et al. .... 439/37
2005/0012619 A1 1/2005 Sato
2006/0125642 A1 6/2006 Chandaria
2006/0128169 A1 * 6/2006 Marmaropoulos et al. .... 439/37
2006/0172719 A1 * 8/2006 Chen et al. ..... 455/333
2007/0105404 A1 5/2007 Lee et al.

FOREIGN PATENT DOCUMENTS

WO 2005013738 * 2/2005

* cited by examiner

FIG. 2 FIVE TYPES OF FEMALE CONNECTOR PCB's

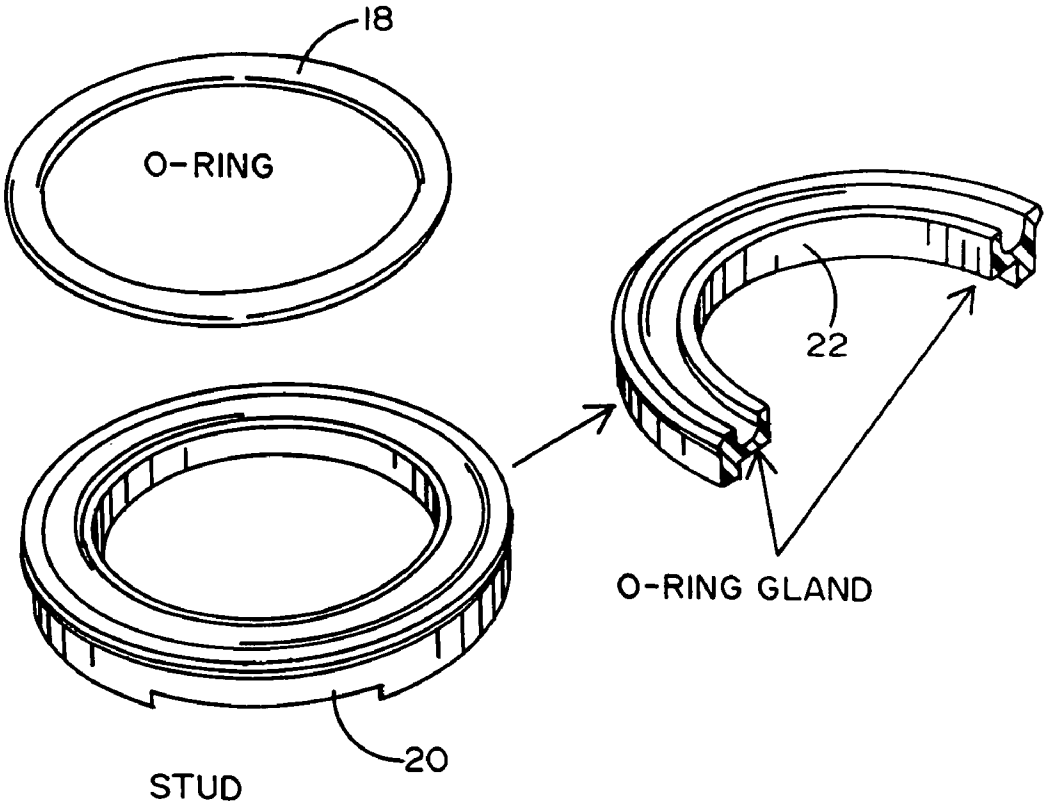
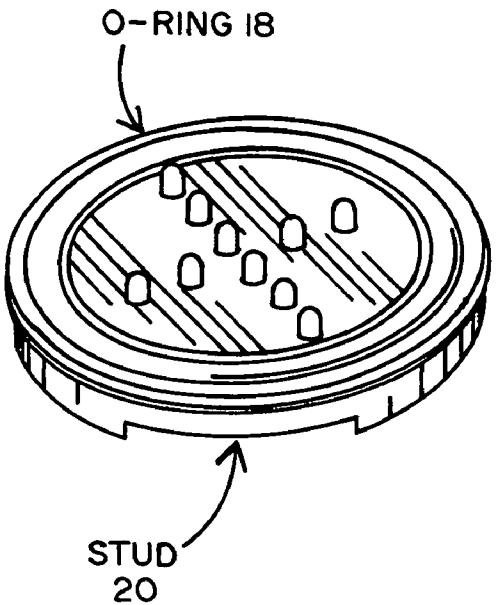
FIG. 4

WIRELESS CAMERA
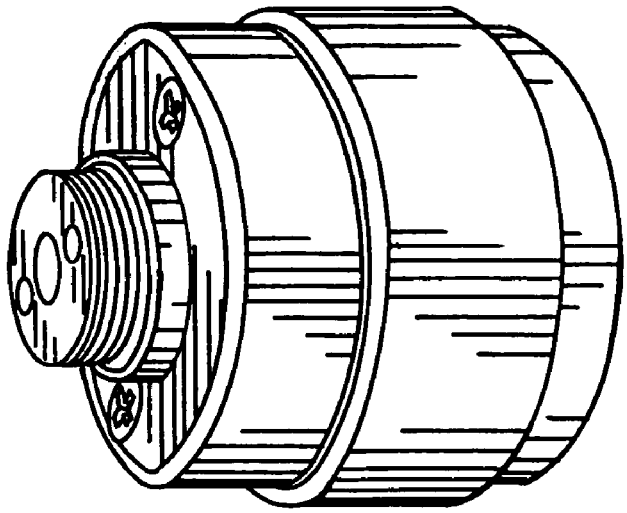
MALE CONNECTOR
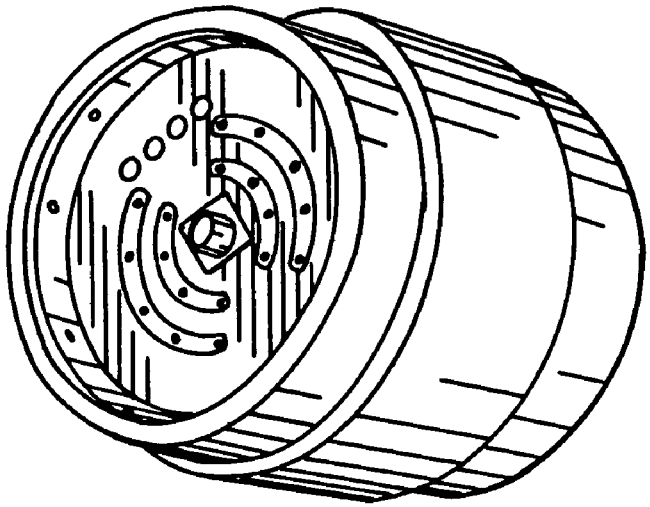
FIG. 14

ELECTRICAL CONNECTOR CONFIGURED AS A FASTENING ELEMENT

GOVERNMENT INTEREST

The invention described herein was made with Government support under contract W911QY-04-C-0038 awarded by the U.S.A. Soldier Systems Center in which the Government has certain fights in the invention.

BACKGROUND OF THE INVENTION

1. Field of the Invention

The present invention relates to a connector configured as a fastening element. Some embodiments are in the form of a wearable "smart" electrical connector and associated connector system in the form of a modular network, which for the first time integrates electronics into protective clothing in a body-conformable and comfortable fashion. It has these unique features: wearability compatible with existing and future military/civilian vests/uniforms; a button-like snap-fastener that can be snapped and unsnapped "blindly" with one hand; and resilience to harsh temperature/humidity, chemicals, water and laundering. Another embodiment is employed in a carton-centric system to indicate tampering with the carton during transit.

2. Background Discussion

Electronic devices are being miniaturized for personal use, but no comprehensive connector technology exists to integrate them into clothing in order to integrate electronics into clothing in a body-conformable and comfortable fashion. The present invention comprises a wearable connector element and interconnects for it, satisfying the need for body-conformability/comfort, specific environmental stability (to harsh weather and laundering) and mission-specificity, as well as a real-world architecture for military and non-military garments.

There is a need for a secure system to ensure that the integrity of a shipping carton within an intermodal shipping container (International Standards Organization) has not been compromised during shipment. Current carton security systems do not meet homeland security needs and require bulky electronics and specialized shipping cartons with hard cases and traditional switch-activated intrusion alarm systems.

SUMMARY OF THE INVENTION

The present invention comprises an entirely wearable electrical connector for power/data connectivity. The principal element of the network is the wearable electrical connector, which is integrated into a personal area network (PAN) with USB compatibility. In general, the network layered architecture corresponds to four Open Systems Interconnect (OSI) layers: physical layer-1; data link layer-2 (intra-PAN); network layer-3 (inter-PAN); and application layer-4 interface. Our effort focused on layer-1 (connector and interconnects), and intra-PAN layer-2.

Progressively more mature wearable connector prototypes were developed. The first, an O-ring based prototype, was subsequently replaced by a more mature second prototype, which is based on a novel anisotropic pressure sensitive conductive elastomer. Both are snap-style, low-profile, 360°-moving, round, blind operable, plug-and-play, reconfigurable wearable connectors with power/data daisy-lattice-style connectivity. A third embodiment comprises a non-conductive elastomeric environmental seal. A fourth embodiment utilizes a self-actioning, automatic shutter-type environmental seal. A fifth embodiment reduces the dimensions of the connector to that of a conventional snap fastener commonly used on clothing and employs an iris-like sealing mechanism.

The basic wearable connector specifications are:

- USB 2 compatible (480 Mbps)
- Human body conformable and comfortable
- One-hand, blind operable (360° rotational symmetry)
- Durable, rugged (low-profile, button-like shape) and easy to operate (snap style)
- Operable at temperatures from −65° C. to +125° C.
- Environmentally resistant (functions under chemically contaminated conditions)
- Low-cost, mass-producible (off-the-shelf common materials)
- Multi-operational, reconfigurable smart connector that can self-terminate; performs automatic routing; self-diagnose, and identify connected devices; and automatically adjust to power requirement.

The wearable connector, network connectivity, and a personal area GPS/medical network on a military-style vest have been demonstrated, including the following features:

- Snap fastener capable of interfacing (through the invention's network hub) a medical heart rate monitor into the USB network
- GPS device and a PDA connected via wearable snap fasteners into the personal area network
- Integration with a ribbon-style USB narrow fabric cable sewn into seams
- Wireless system communication via an 802.11b card in the PDA to display the location and heart rate of the wearer.

The present invention represents the first fully functional wearable connector, with three major unique features: wearability and compatibility with conformability to existing and future military/civilian vests/uniforms; snap-fastener button-like style, so that it can be snapped and unsnapped "blindly" with one hand; mechanical stability and resilience not only in standard environments of temperature and humidity, but also to aggressive chemicals, water and laundering.

The present technology will also benefit many outside the military, especially public safety personnel such as police, fire, EMT and other services that require special protective clothing integrated with multiple electronic devices. Other applications include special clothing for the disabled, prisoners, the mentally ill and children. Outdoor computer-game commercial applications are also obvious candidates to benefit from the disclosed technology. These wearable connector technology can be both retrofitted into existing designs of protective clothing and added to new uniform/vest designs.

The wearable connector of the invention is also disclosed herein in an embodiment suitable for use in ensuring the integrity of cartons in shipping containers. A connector of the present invention is used in conjunction with a conductive ink "smart-skin" distributed throughout the carton surface and terminating at the connector which, in effect, closes the circuit formed by the paths of conductive ink. The connector is only about one centimeter in diameter in the preferred embodiment for this application. Nevertheless, it is designed to contain two Wheatstone bridges, a battery, an alarm latch and an RFID device to communicate a binary alarm signal to the outside world (i.e., shipping container RFID device).

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which:

FIG. 4 is an illustration of the various components of the male connector of the first embodiment;

FIG. 14 is a photograph of a wireless camera having a male connector integral thereto;

DETAILED DESCRIPTION OF PREFERRED EMBODIMENTS

Wearable Connector Embodiments

Figure 1:
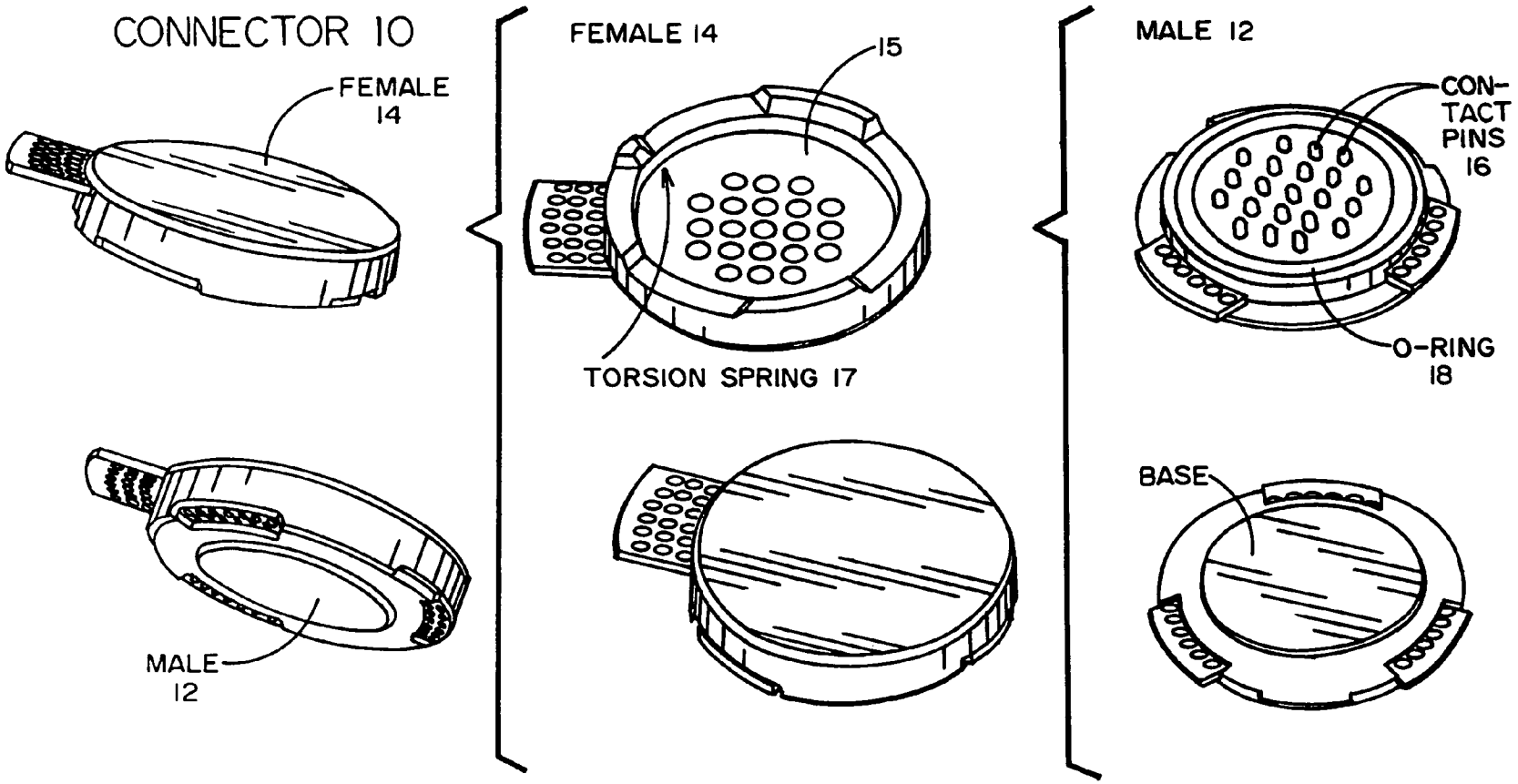
FIG. 1 is a series of three-dimensional views of the male and female connectors of a first embodiment of the invention.

The electrical connector chosen for modular network is the wearable connector 10 (see FIG. 1). This connector 10 is the result of several design and test iterations. The robust wearable electrical connector is capable of delivering both electrical power and electrical signals to devices connected to the body conformable network.

Figure 2:
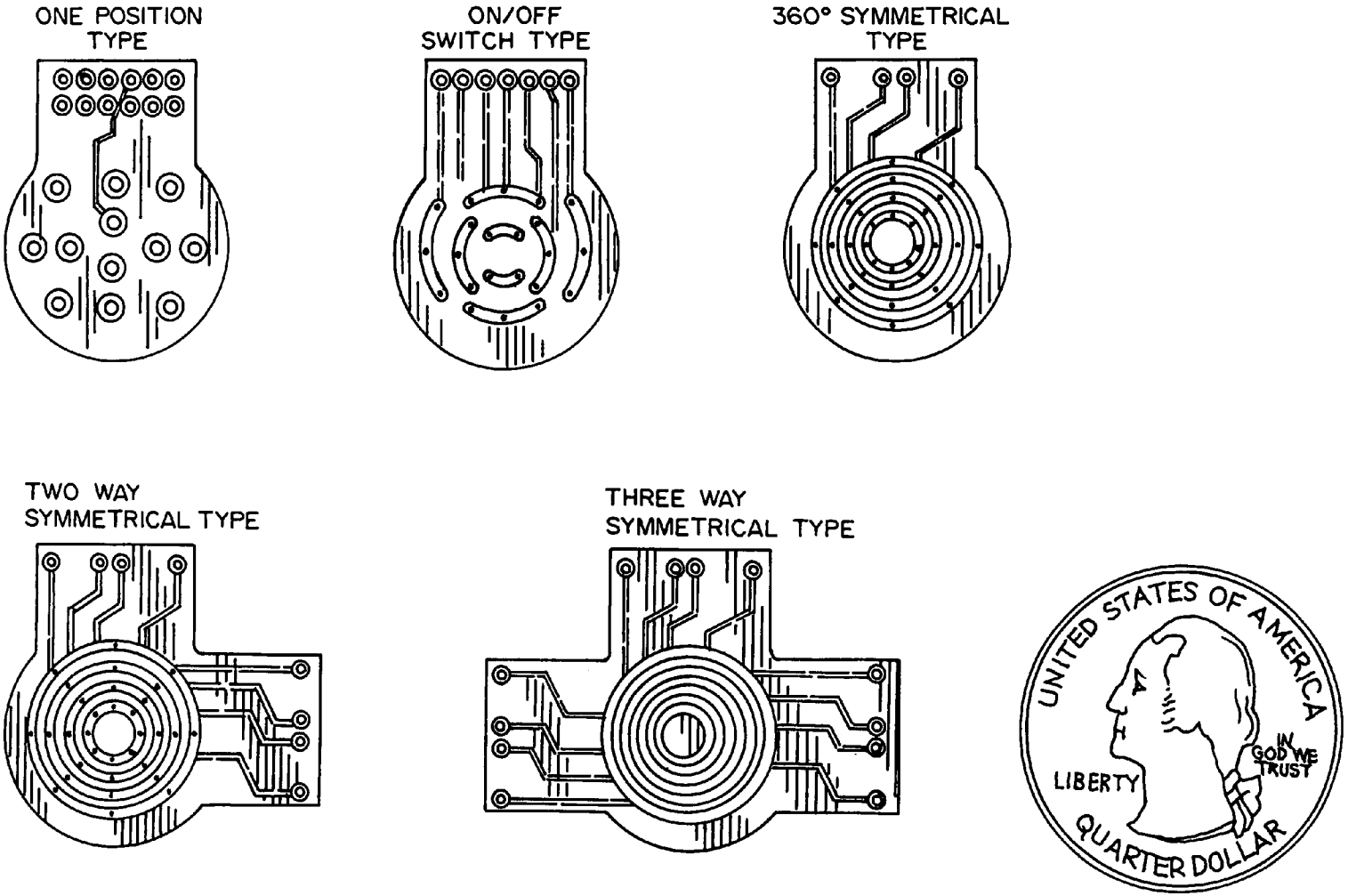
FIG. 2 is a photograph of various female connector PCB configurations of the first embodiment.

This connector is the first "truly blind" electrical connector developed for the wearable environment. The wearable snap connector can be engaged reliably in total darkness, using only one bare or gloved hand and in one simple movement. The wearable snap connector does not have to be meticulously aligned before mating. In fact, it has full 360° freedom in one plane (see FIG. 2).

Mating the male and female halves 12, 14 of the wearable connector is simple and intuitive. Everyone is familiar with clothing in which snaps join segments of fabric. The wearable connector is simpler than zippers, which often require the use of two hands (or visual alignment). The snaps can be mated with only one hand and without the need for visual alignment. The inventive snap connector is identical to a traditional garment snap in the operational sense. No special training or skills are needed by personnel wearing modular network garments in order to attach or detach electrical devices.

Figure 3:
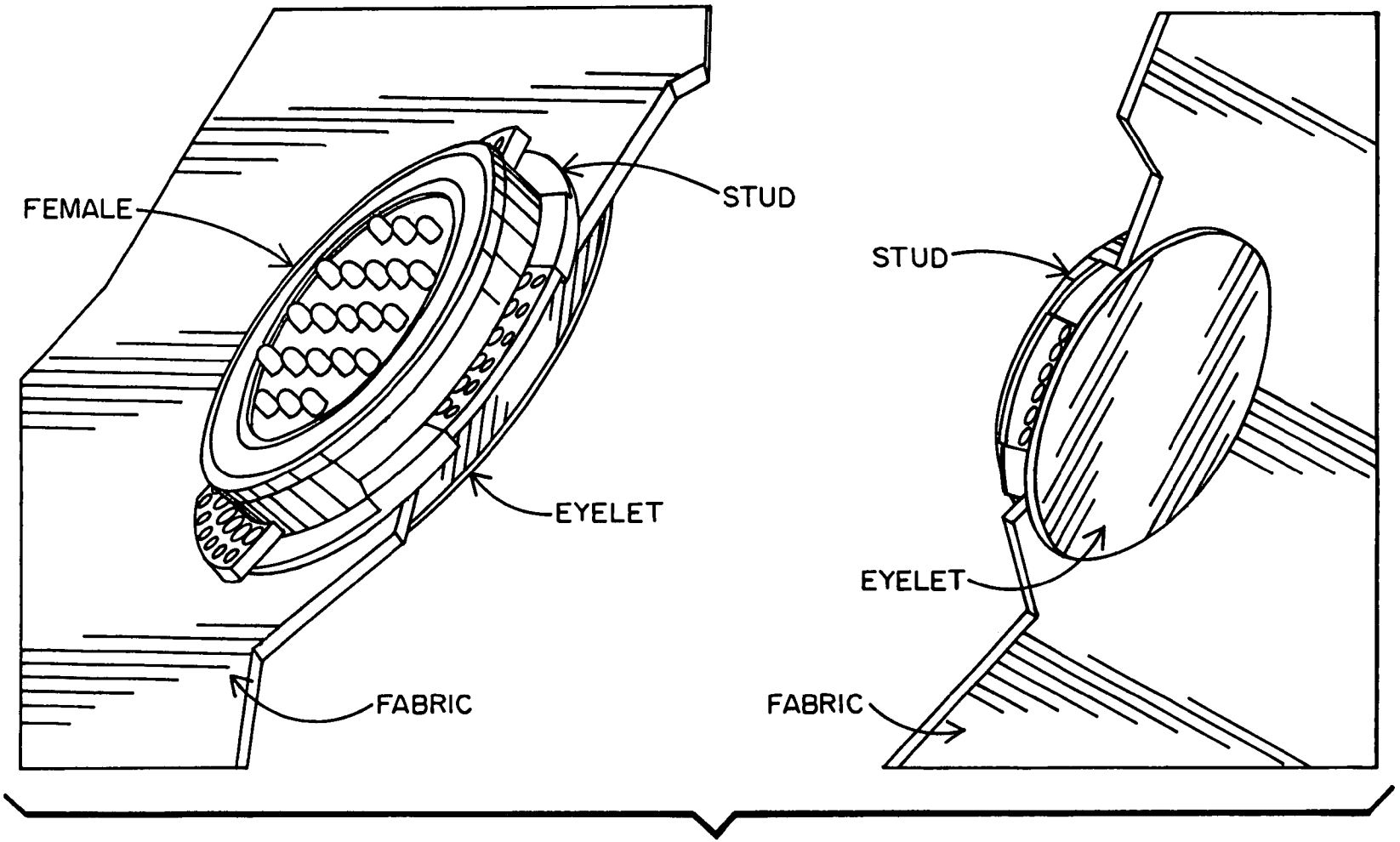
FIG. 3 is an illustration of the fabric/female connector interface.

The wearable snap connector has a low-profile, symmetrical (round) design, which can be easily integrated into existing garments (see FIG. 3). The housing of the wearable snap connector can be riveted or sewn into garments, much as traditional snaps are currently affixed.

These styles of attachment give the wearable snap connector excellent protection against the rigors of wear and laundering. The electrical contacts of the wearable snap connector are protected against the elements, and dry and liquid contaminants such as perspiration, dirt, water, oil, solvents, laundry detergent and the like, such as by an O-ring 18 (a torus-shaped mechanical component manufactured from an elastomeric material) seal. O-rings seal by deforming to the geometry of the cavity 22, called a gland, to which they are fitted. The O-ring is then compressed during the fastening process to form a tight environmental seal. In one embodiment of wearable snap connector, the radial seal around the circumference of the electrical connectors is formed by machining the circular gland near the outer rim of the connector body (see FIG. 4). The O-rings are 2% oversized for a robust interference fit within the gland.

Considerations in the design of this environmental seal include size and shape of the gland, the size and shape of the O-ring (inner diameter, minimum cross-section diameter, maximum cross-section diameter, cross-section tolerance, minimum compression and maximum compression), and the material from which it is to be manufactured. Various elastomers may be utilized to form the O-ring, based upon their physical durability, resistance to solvents and other chemicals, and their temperature range. Silicone rubber was selected for the experimental prototype.

The wearable snap connector terminates the wearable electrical cable, which forms the backbone of the body-conformable network. This termination connection was made by soldering. Other methods such as insulation displacement connection may be employed.

Figure 5:
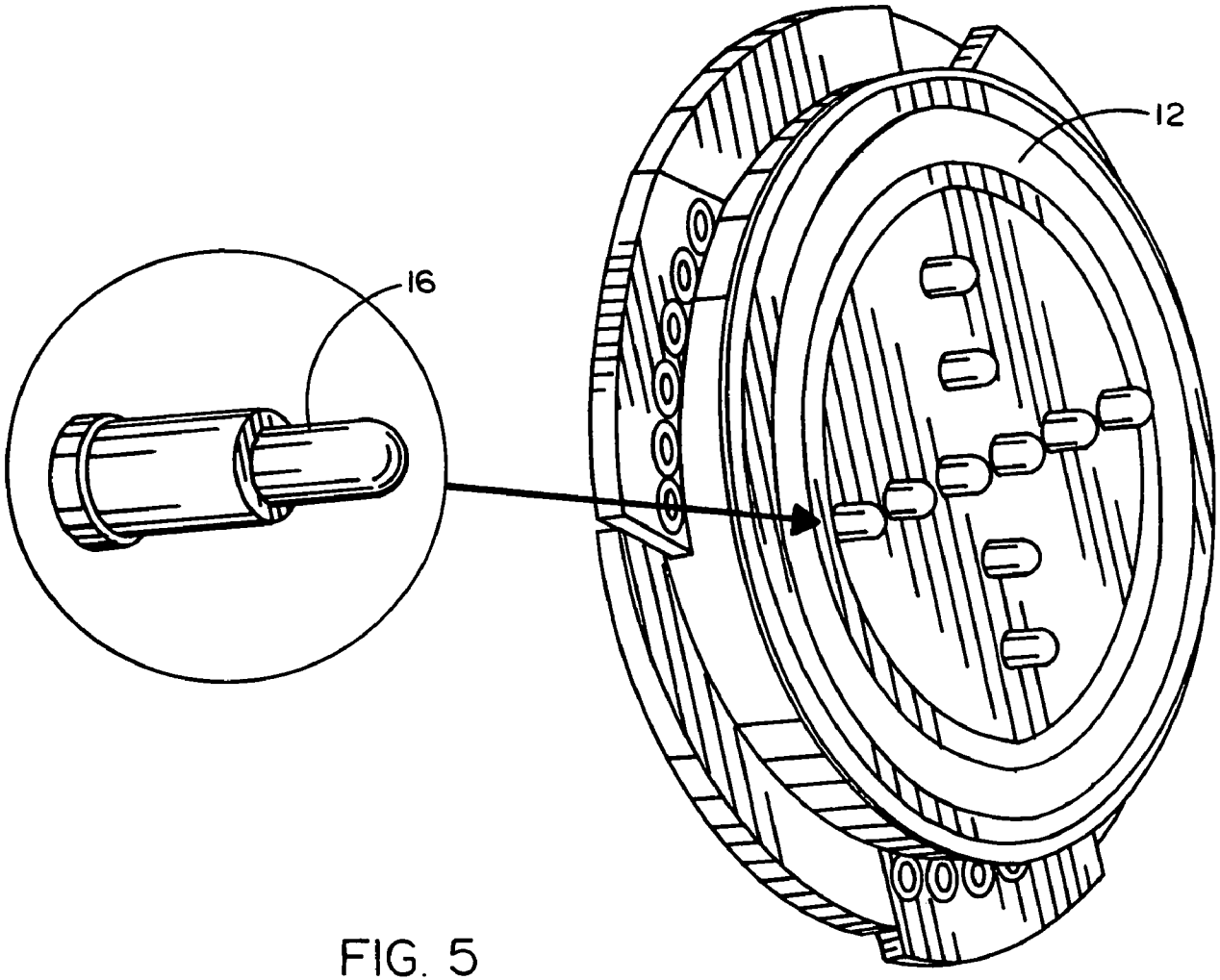
FIG. 5 illustrates the pins of the male connector.

The wearable snap connector pin contacts 16 are spring-loaded and self-wiping (see FIG. 5). Being compression-spring-loaded, the wearable snap connector contact pins compensate for vibration, twisting, and turning of the connector, keeping a constant pressure between the metallic contact surfaces within the two halves of the snap connector. Mill-Max Manufacturing Corporation in Oyster Bay, N.Y. manufactures the spring-loaded pins with a minimum life of 100,000 cycles that were utilized to fabricate the prototype snap fastener connectors. Additional specifications of these contact spring-loaded pins are presented in FIG. 5.

The oxides that can form on the surface of metallic contacts are wiped away by the mating action of the two halves of the snap connector. This action extends the time between manual contact cleanings and may even eliminate the need for such operations in some environments.

The connectors may be radio frequency interference (RFI) and electromagnetic interference (EMI) shielded, as may the wearable cabling backbone. Decoupling capacitors and (optionally) metal-oxide varistors (MOVs) can reduce and/or eliminate disruptive electrical noise and harmful electrical spikes at the connection points.

Network Performance

The network is capable of carrying various types of electrical signals in addition to power. The electrical signal specifications listed in Table 2-1 are representative of the type of electrical signals that the invention is capable of transporting. This list is not all-inclusive.

TABLE 2-1

EXAMPLES OF ELECTRICAL SIGNALING METHODS

| SIGNAL | TYPICAL BANDWIDTH |
|---|---|
| Ethernet | 10 Mbps-100 Mbps |
| USB 2.0 | 480 Mbps |
| RS-170/343 | 4.5 MHz (RS-170A) |
| IEEE 1394 (FireWire) | 400 Mbps |
| RS-232 (C, D, and E) | 115 kbps |
| IEEE 1284 | 3 Mbps |

From these, we selected the Universal Serial Bus (USB) version 2.0 specification to be used for the prototypes for both its high data rate and its compatibility with wearable data cabling. USB 2.0 480 Mbps capability is essential for high bandwidth visual communication, such s 2.5 G and 3 G RF wireless/cellular and to transmit even VGA video (740×480, 24 bpp, 30 fps). One USB connector can support up to 127 USB devices, such as sensors, digital cameras, cell phones, GPS and PDAs (personal digital assistants). The need to connect to a PC is completely eliminated. For example, a digital camera could transfer pictures directly to a printer, a PDA or microdisplay, and become in effect a miniature PC. The USB protocol supports intelligence to tell the host what type of USB device is being attached and what needs to be done to support it. USB (among other features):

Is hot-pluggable (new attachment/detachment automatically detected)

Performs error detection and recovery

Supports four types of transfer (bulk, isochronous, interrupt, control).

In the near future, efforts in the 802.15a (ultrawideband) area will lead to a USB 2.0-compliant wireless interface. For now, only 802.15.3a as been defined for USB.

An enhancement to the wearable connector includes OSI Layer 2 (and potentially Layer 3) functionality. We call this enhancement the Smart Self-Contained Network-enabled Apparel-integrated multi-Protocol Snap connector enhancement.

Data Link layer functionality is supported by including electronic serial numbers at the wearable snap-connector points. These points serve as node connection points at Layer 2. Electronic serial numbers will serve as Media Access Control (MAC) addresses, identifying devices attached anywhere within the network. This can serve not only to notify the network of a device being connected and disconnected, but can also maintain a dynamic inventory of all modules attached to a network-enabled garment. Since both halves of the wearable connector will have such MAC addresses, even non-network-aware modules such as batteries or analog sensors can be identified for inventory and automatic configuration purposes. This also allows for the assignment of a Layer 3 address (such as an Internet Protocol (IP) address) to a personal area network (PAN) on a network-enabled garment even when no other electronic devices are attached to any network nodes. This can locate, inventory and address each individual PAN within a local area network (LAN) or within a wide area network (WAN).

In a second embodiment, the O-ring is replaced with a conductive elastomer-based sealing mechanism, which seals not only when mated but also when unmated.

Figure 6B:
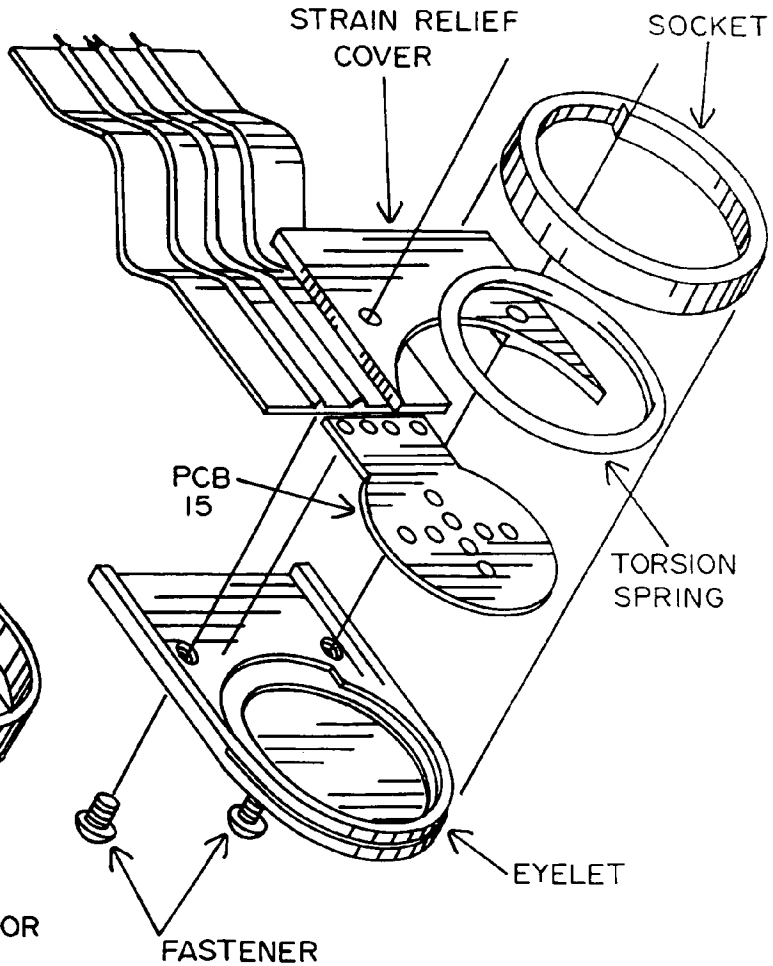
FIG. 6, comprising FIG. 6(*a*) and FIG. 6(*b*), are illustrations of the first embodiment female and male connector/cable interfaces.
Figure 6A:
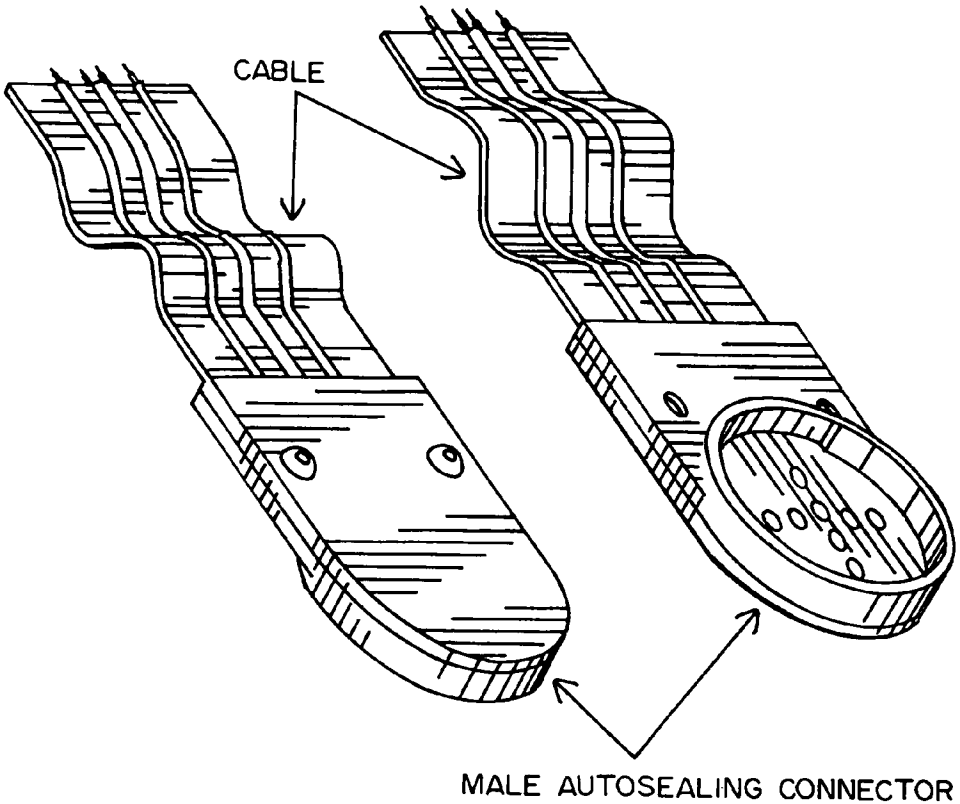

The invention also comprises the integration of the wearable snap connector with narrow fabric electrical cable conduits and their embedded conductors (see FIG. 6). We enhanced self-sealing capability by connector redesign.

Figure 7A:
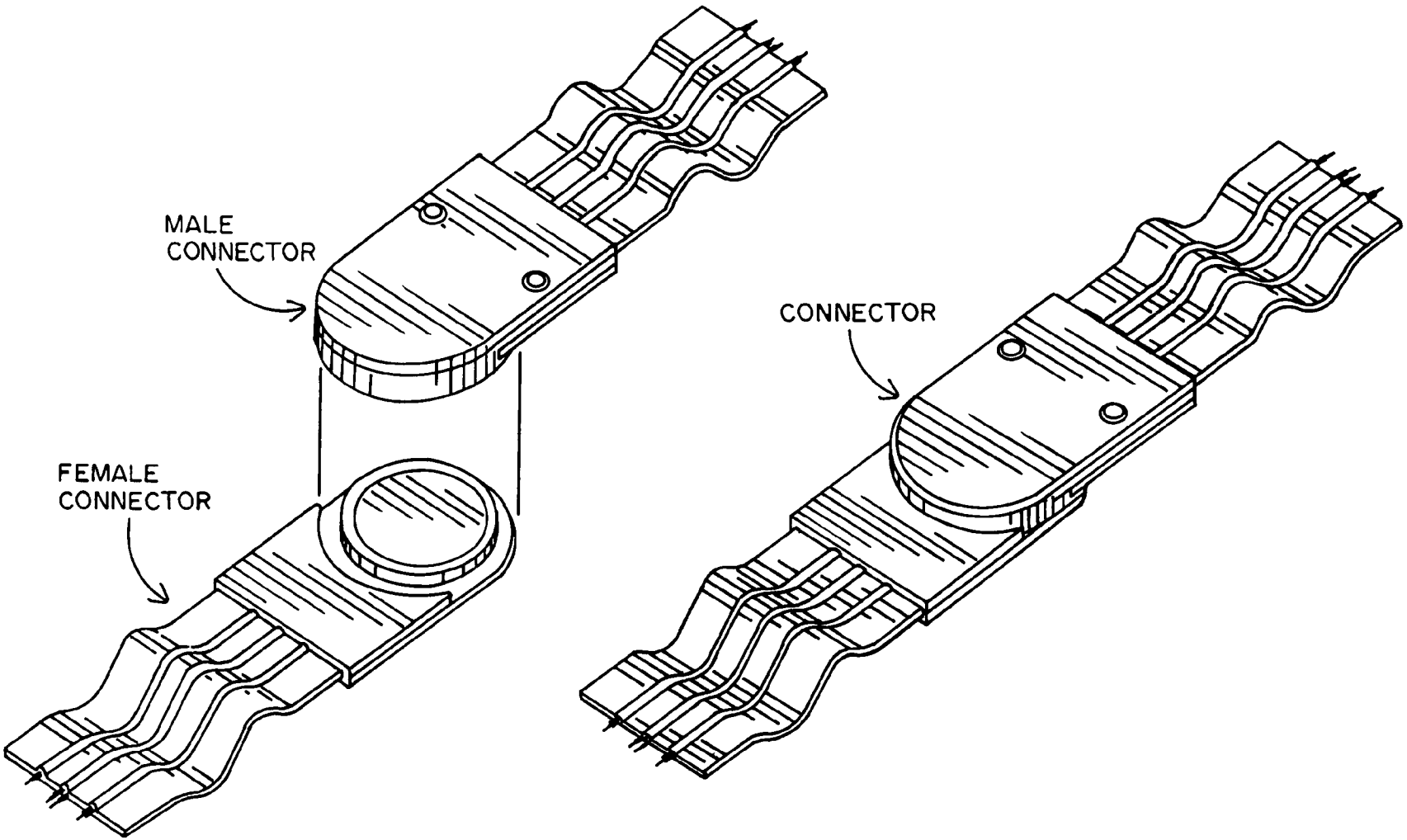
FIG. 7, comprising FIG. 7(*a*) and FIG. 7(*b*), are illustrations of the second embodiment female and male connector/cable interfaces.
Figure 7B:
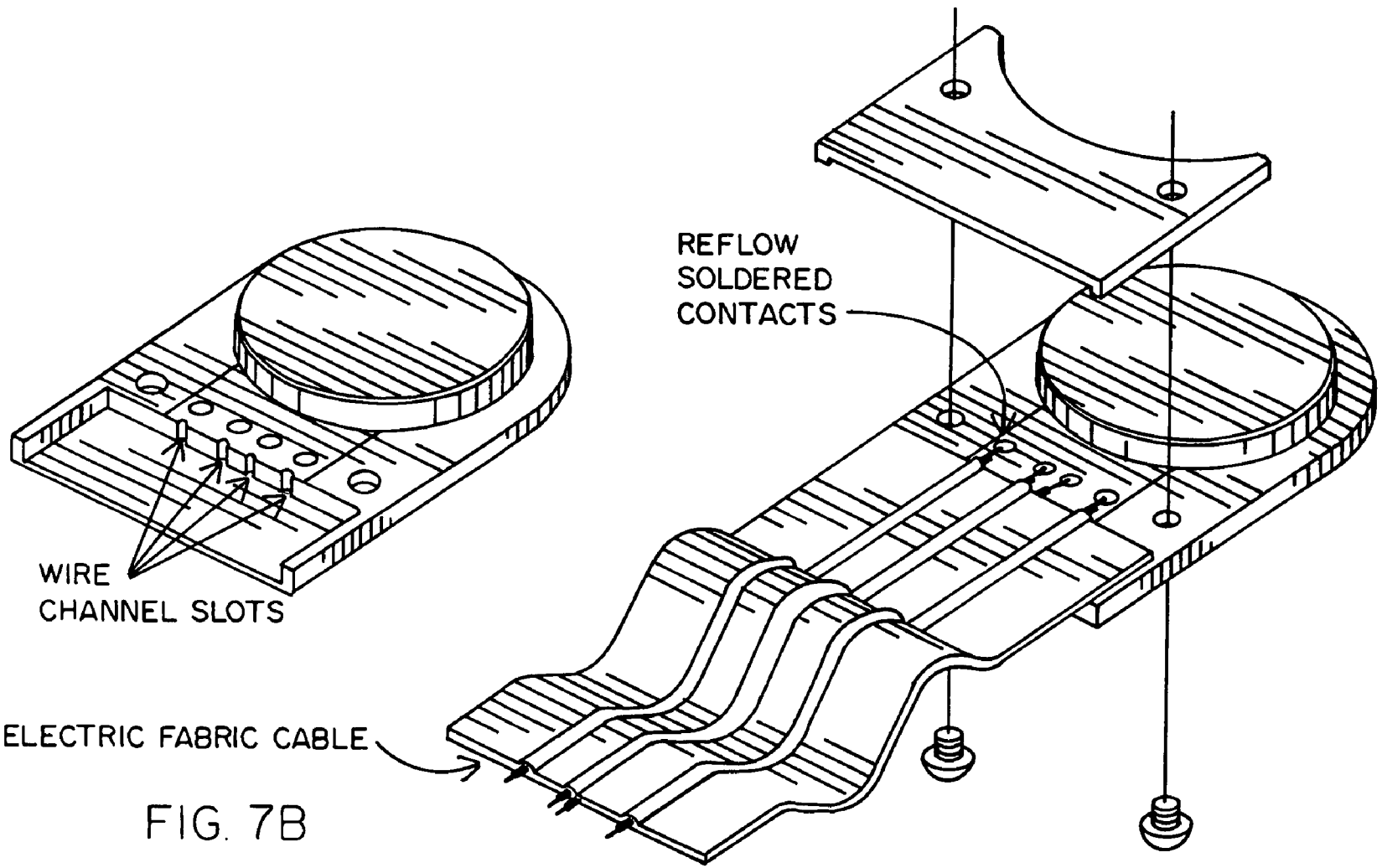

Reflow soldering connects the individual wires from the narrow fabric cable to the interconnect contact pads on the PCBs 15 in the snap connector as shown in FIG. 7.

Figures 8A, 8B:
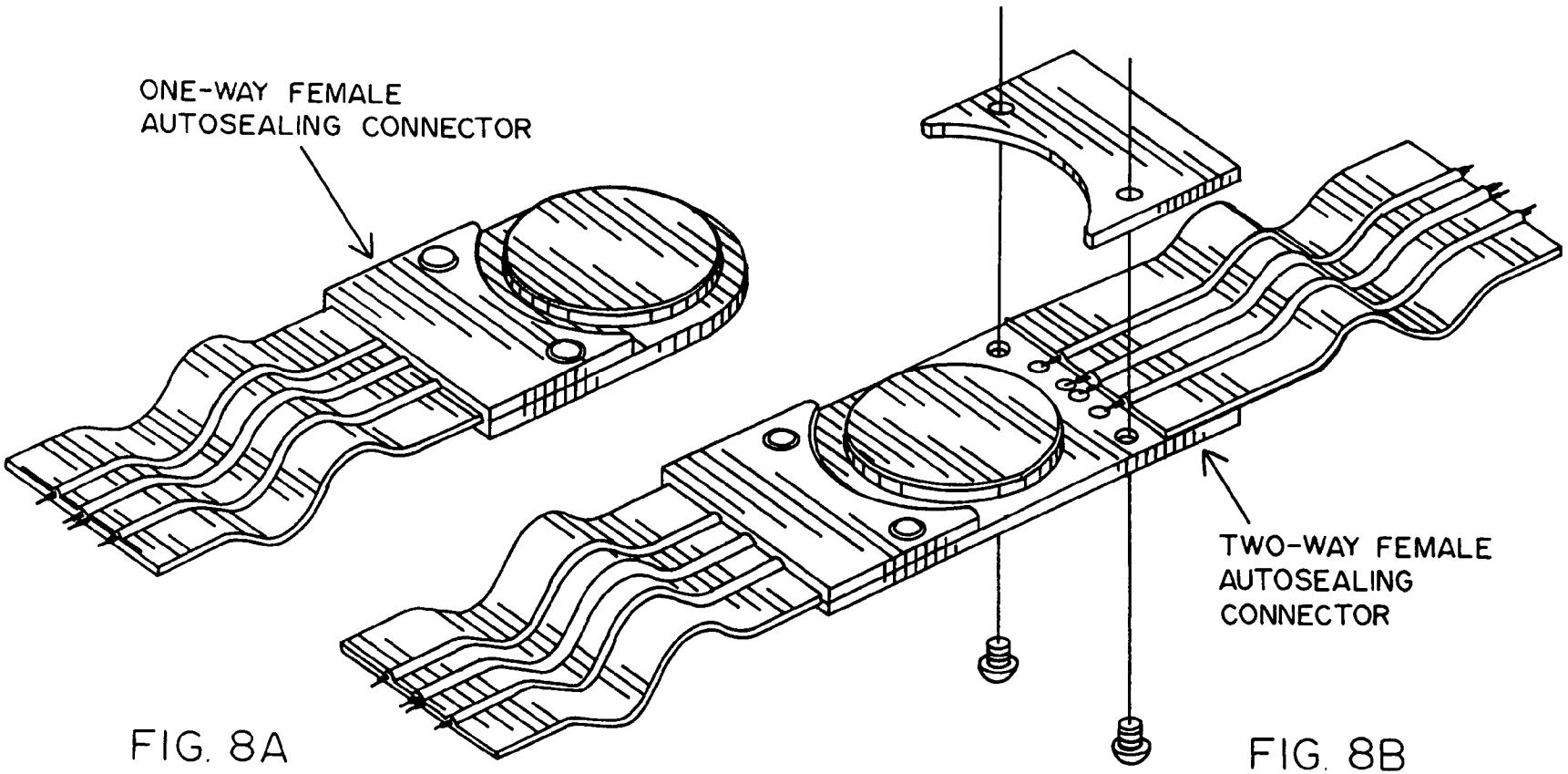
FIG. 8, comprising FIGS. 8(*a*), 8(*b*), 8(*c*) and 8(*d*), illustrate four alternative female connector/cable interfaces for one-way, two-way, three-way and four-way interconnections.
Figure 8C:
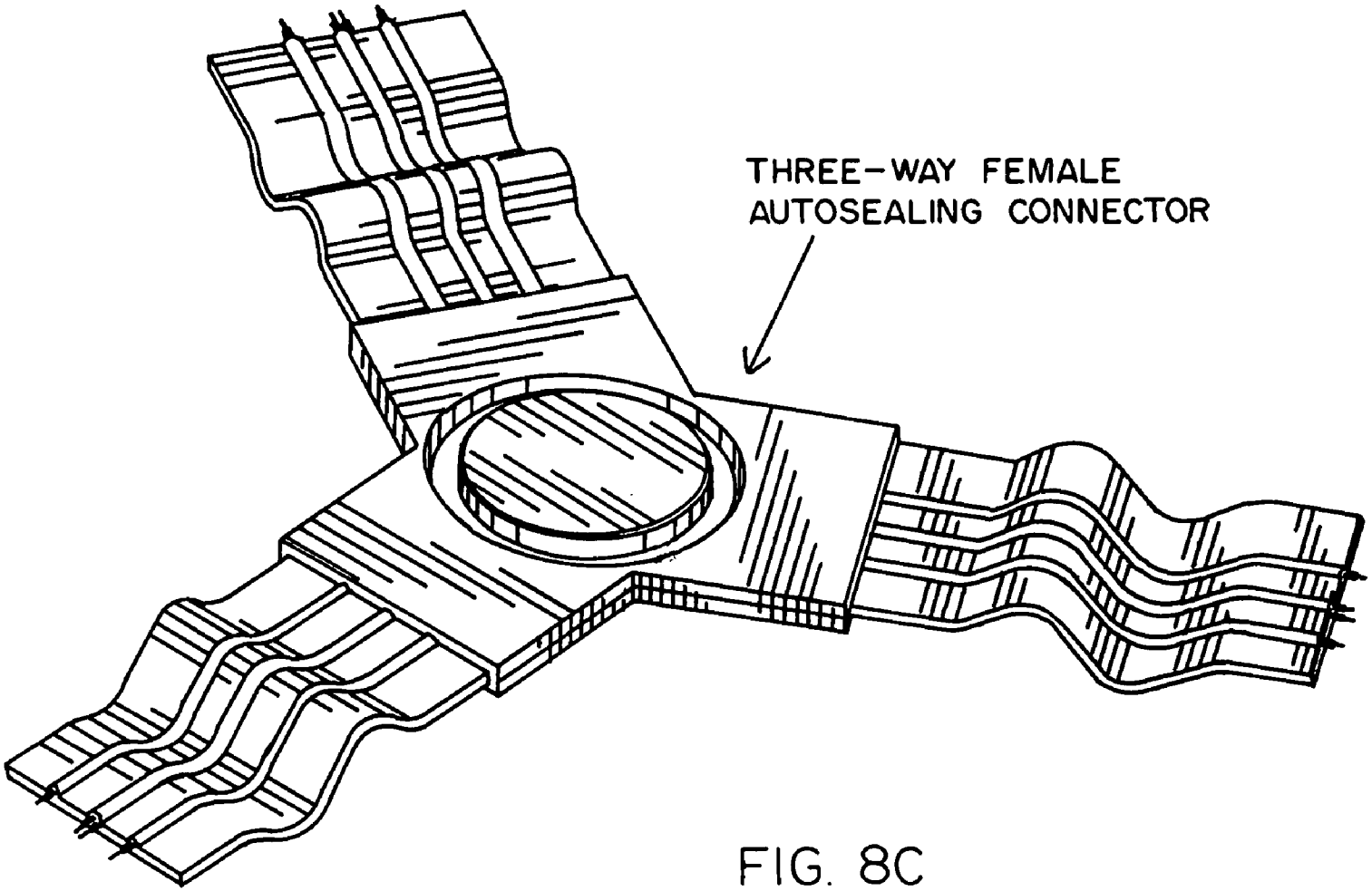
Figure 8D:
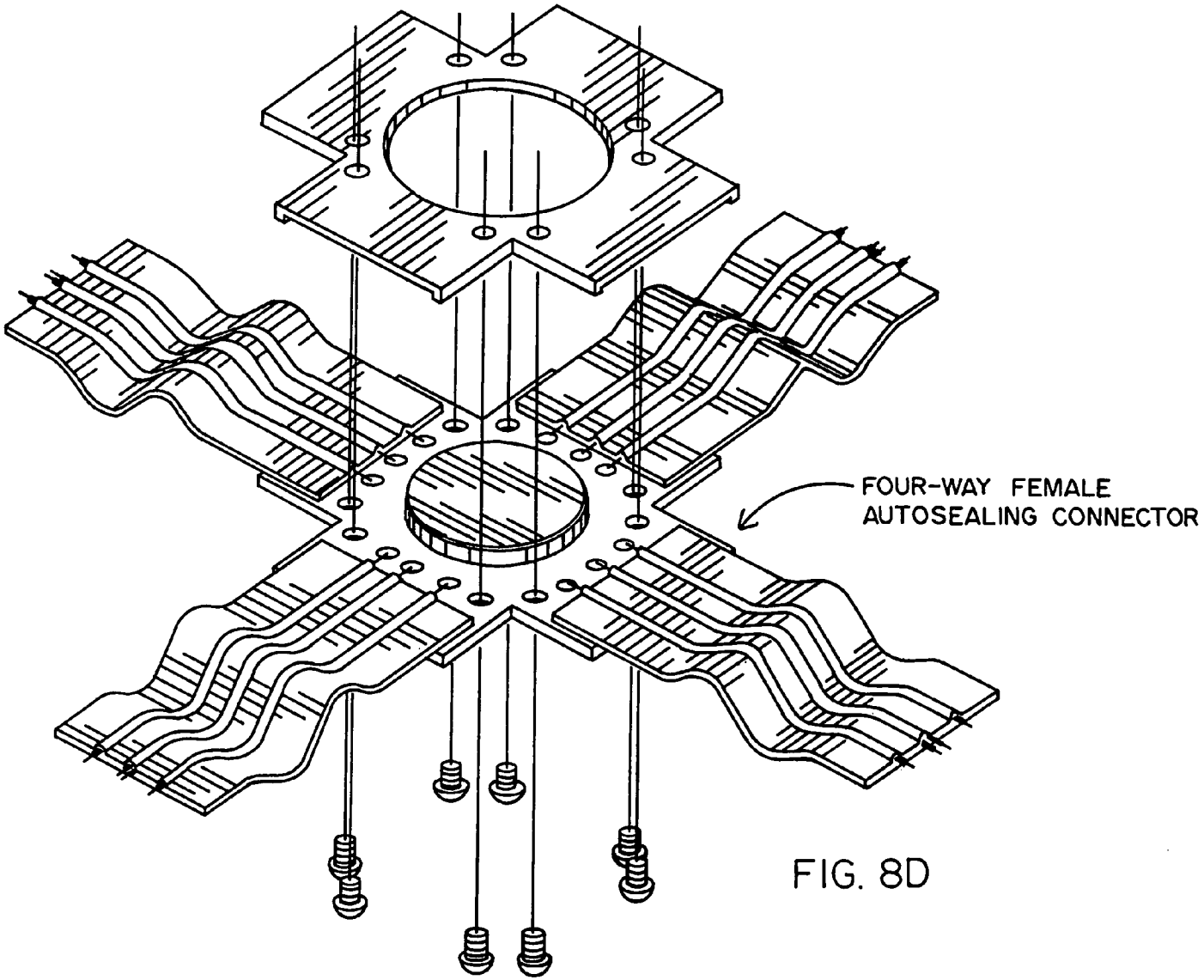

Although one can manufacture woven e-textile cables, the connector is designed to fully integrate with existing narrow fabric cables in various configurations, accommodating the existing form factor and electrical specifications, as shown in FIG. 8. The female connector configuration can be varied to increase the degrees of freedom in the interconnectivity of devices within the network.

One can easily apply the highway analogy to the multiple configurations possible for the female portion of the wearable connector/cabling subsystem. Sometimes only a "dead-end" road is necessary, like the "one-way" female cable. In this case, the connector-terminated narrow fabric can be used for garment-to-device connection, or garment-to-garment connection. At other times, a through road is desirable. We want our vehicles (power and data packets) to be able to keep on going, but we also want to allow the flexibility to exit or enter the road before it ends, somewhere in the middle. The two-way connector satisfies this need. Still, at other times we need to exit (or enter) a highway junction from many directions. The three-way and four-way interconnects allow us to do just that. Like a highway interchange, they allow power and data to flow in multiple directions within the network, yet also allow data and power to enter or exit at the nexus of this "super-junction." The narrow fabric interconnects to the garment essentially become data superhighways, which can distribute data and power to all parts of the garment reliably and elegantly in a body-conformable configuration.

Figure 15:
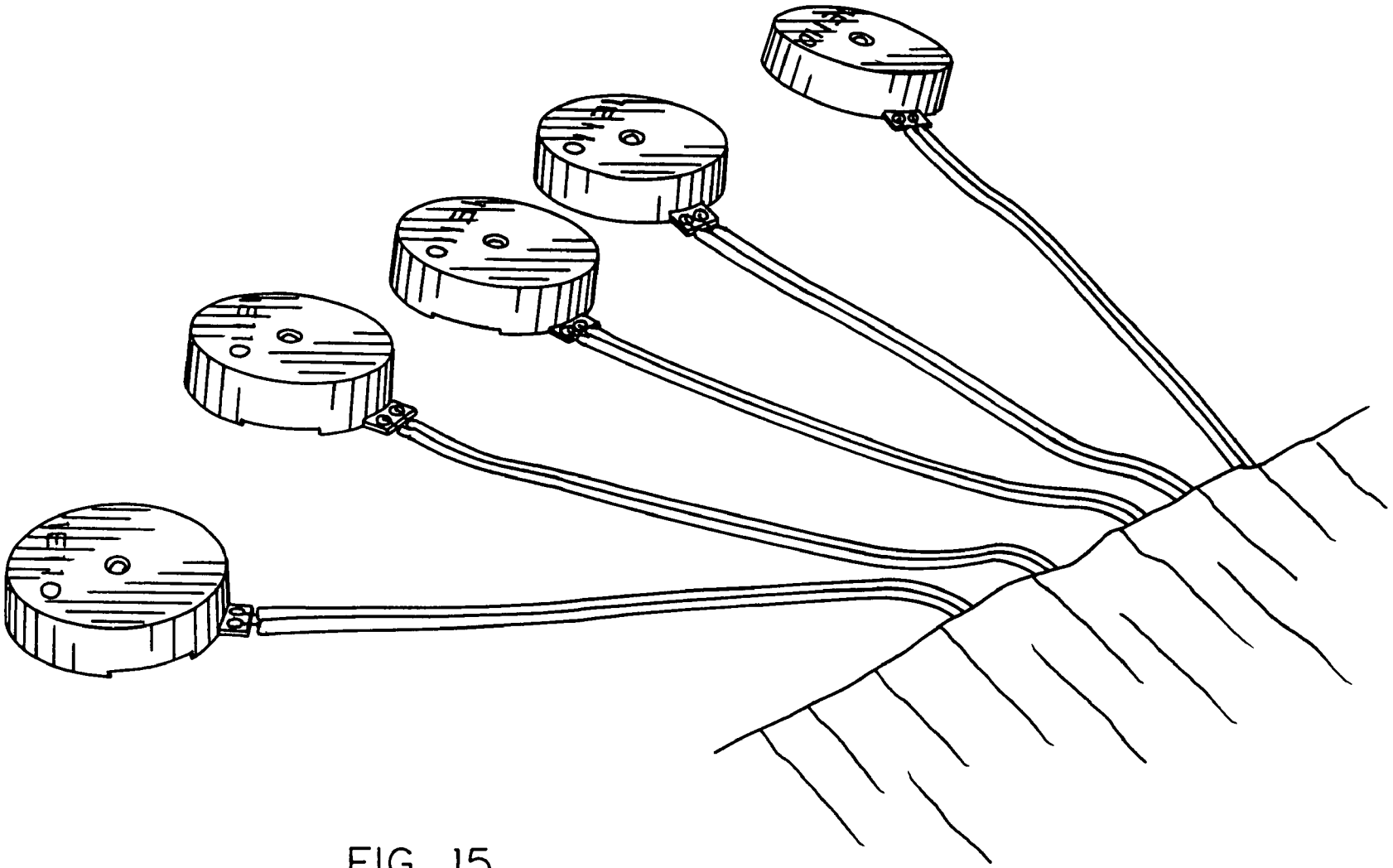
FIG. 15 is a photograph showing a number of haptic actuators affixed to strategic locations on a garment to provide the wearer with directional information that he or she can feel.

Male wearable connectors can also be in a stand-alone configuration. Instead of terminating a narrow fabric cable that leads elsewhere, they may go nowhere. A chemical, biological, physiological or environmental sensor or other device such as a haptic-feedback stimulator (see FIG. 15) or emergency beacon can be integrated within one male connector. Such a microelectronic device can be housed in its entirety on the male connector, so that a one can electrically connect and mechanically mount a miniature electronic or electromechanical device such as a sensor, stimulator or beacon in one step, simply by snapping it on. FIG. 14 shows a small video camera that has a male connector built in.

Figure 9:
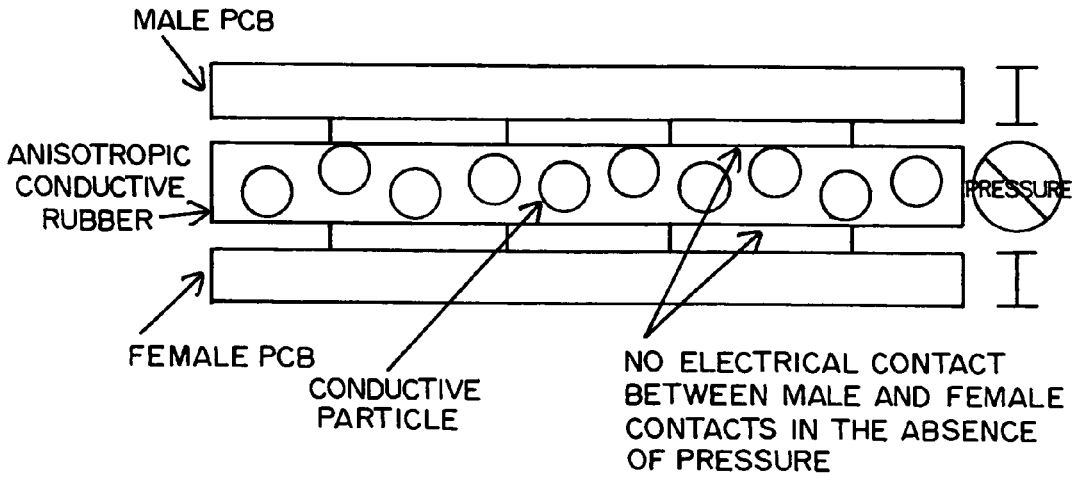
FIG. 9 is a schematic representation of a wearable connector according to a second embodiment shown in its non-conducting condition.

In the second embodiment of the invention an anisotropic conductive rubber layer conducts electricity unidirectionally, always in the vertical or Z-axis. The directional conductivity results from relatively low volume loading of conductive filler. The low volume loading, which is insufficient for inter-particle contact, prevents conductivity in the plane (X and Y axes) of the rubber sheet. This conductive rubber layer is placed between the substrates or surfaces to be electrically connected, in this case, the male and female PCB electrical contact surfaces (see FIG. 9).

Figure 10:
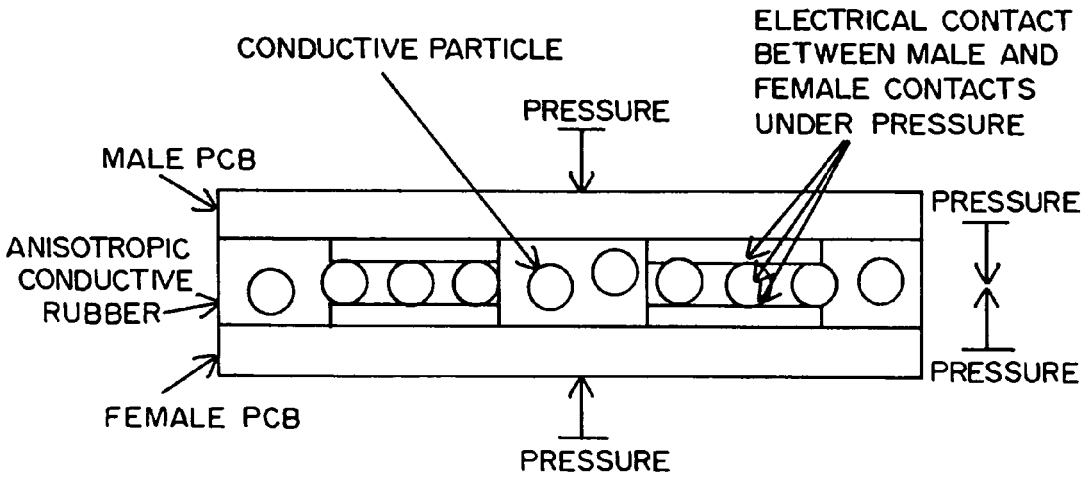
FIG. 10 is a schematic representation similar to FIG. 9, but shown in its conducting condition.

Application of pressure (in the vertical direction) to this stack causes conductive particles to be trapped between opposing conductors on the two halves of the connector (see FIG. 10). This rubber matrix stabilizes the electrical connection mechanically, which helps maintain the electrical contact between the PCB conductors and the conductive particles suspended in the rubber sheet. It both acts as a "contact spring", eliminating costly compression springs on each individual male contact pin and protects against both contact "bounce" during connection and momentary contact interruptions from vibration after mating. Anisotropic conductive products are now being used to connect flat panel displays and other fine-pitch electronic devices. Another characteristic inherent in the rubber matrix is the hydrophobicity of the rubber matrix, making it intrinsically water/moistureproof, a significant asset for the inventive connector.

Benefits of anisotropic conductive rubber layer are:

- Compatibility with a wide range of surfaces and intrinsic hydrophobicity (moisture resistance)
- Low-temperature process; low thermal stress during processing
- Low thermomechanical fatigue; good temperature cycling performance
- No significant release of volatile organic compounds
- No lead or other toxic metals
- Wide processing latitude; easy process control and fine-pitch capability.

Figure 11A:
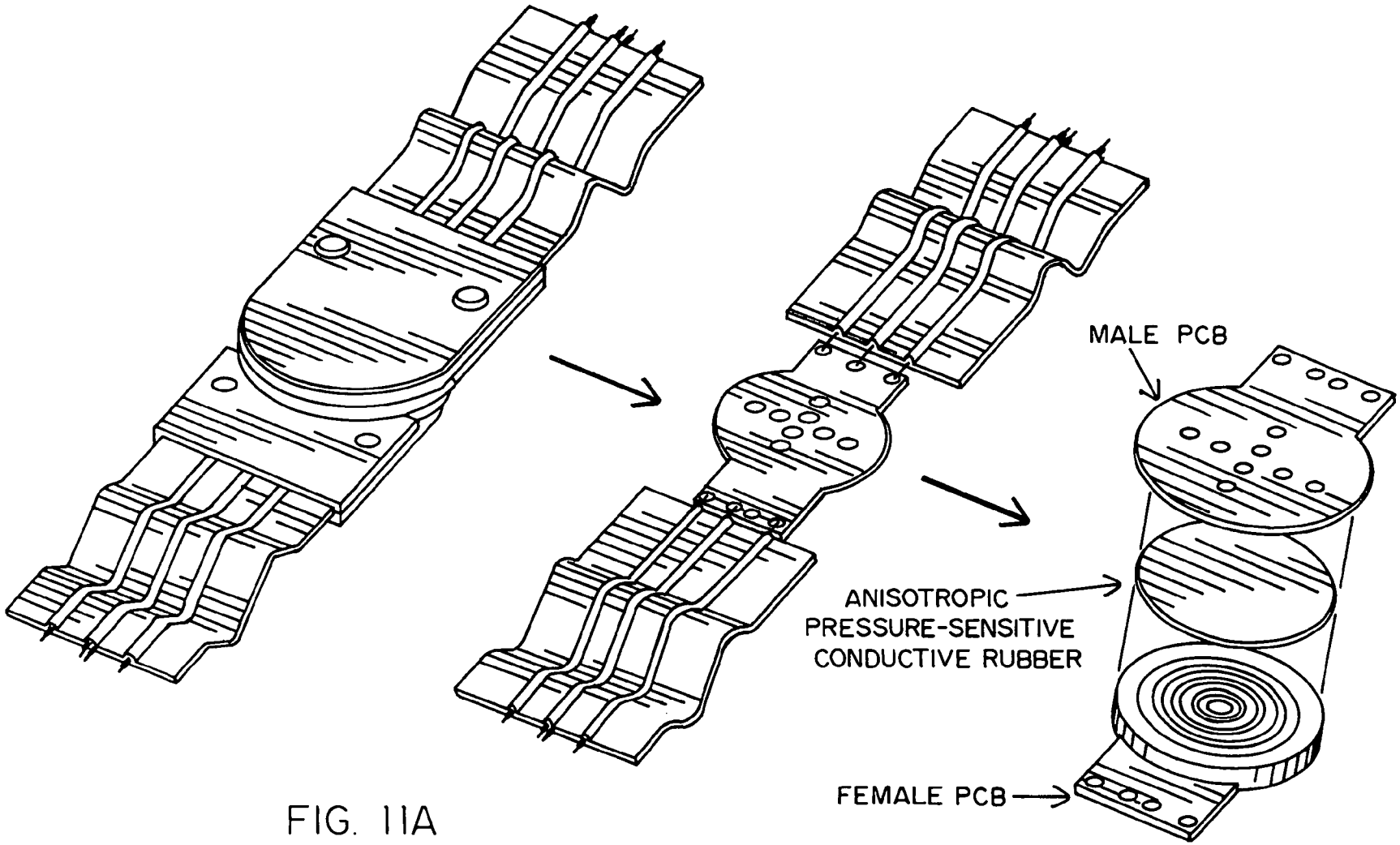
FIG. 11, comprising FIGS. 11(*a*) and 11(*b*), illustrates details of the wearable connector of the second embodiment.
Figure 11B:
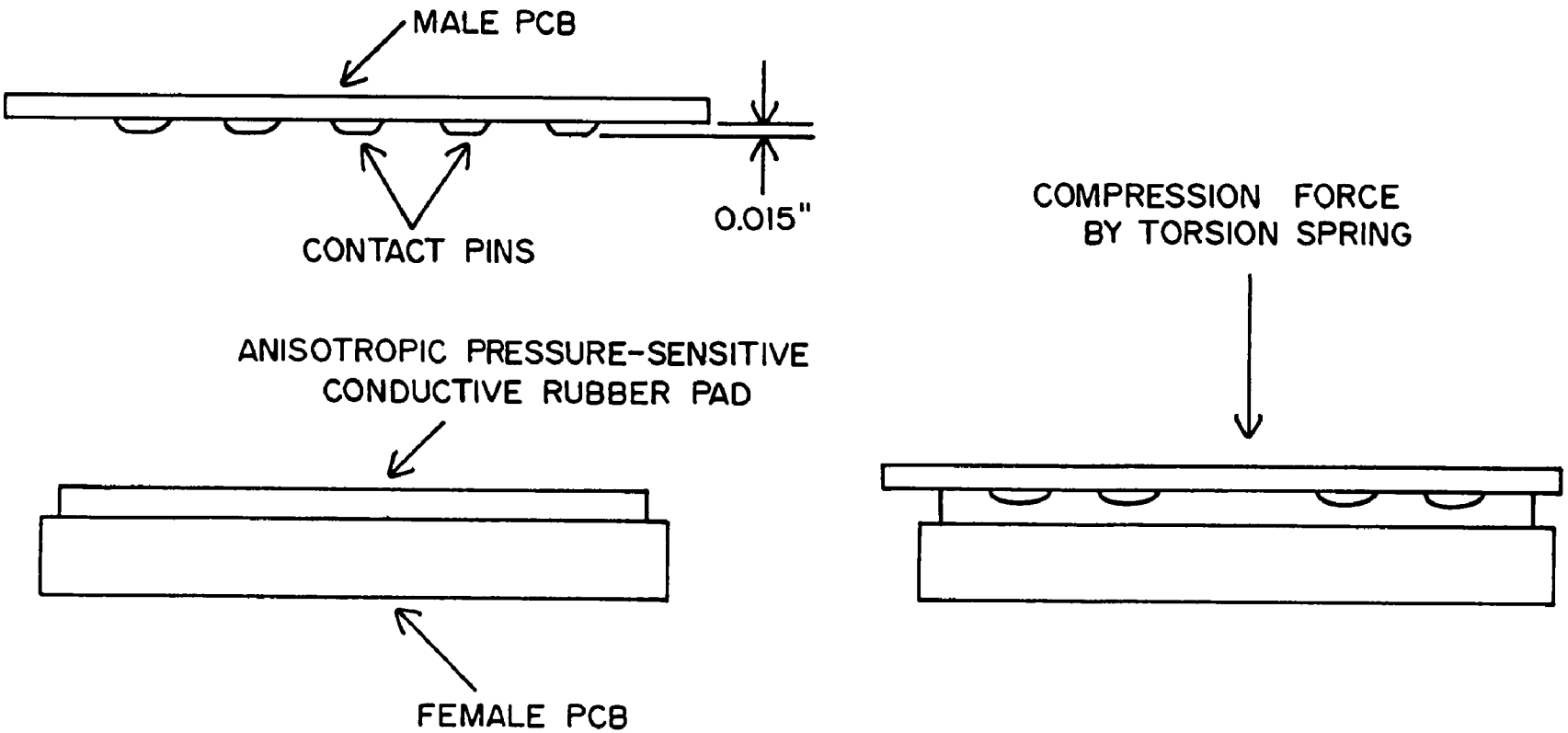

Anisotropic conductive rubber comprising a rubber base compound and suspended conductive particles supports electrical contact between the conductive areas. The conductive rubber can be applied as a top surface layer in the connector (see FIG. 11). The composition of the rubber compound can control the overall hardness of the conductive rubber layer.

The rubber compound is made of room temperature cured rubber, accelerants and precision silver-coated glass microspheres. We have experimented with different ratios of silver-coated glass microspheres and rubber compounds to optimize conductivity.

Regardless of the ultimate source, the conductive rubber sheet will not only form an environmental seal for the connector contacts, protecting them from moisture, dirt, abrasion, solvents and other contaminants, but by reducing oxidation and fretting, will also extend the lifetime (number of usable mating and demating cycles).

The exact hardness of the conductive rubber layer will be determined by the strength of the torsion spring that keeps the male and female halves of the wearable connector mated. A 60 A shore durometer hardness was required for the prototype. Manufacture and installation of the conductive rubber sheets is simple and not expensive. One may design a non-conductive support structure for the conductive rubber sheeting, similar to the function of rebar in concrete structures, to further strengthen the conductive rubber sheet by reducing friability and wear from repeated compression and decompression cycles.

Figure 12:
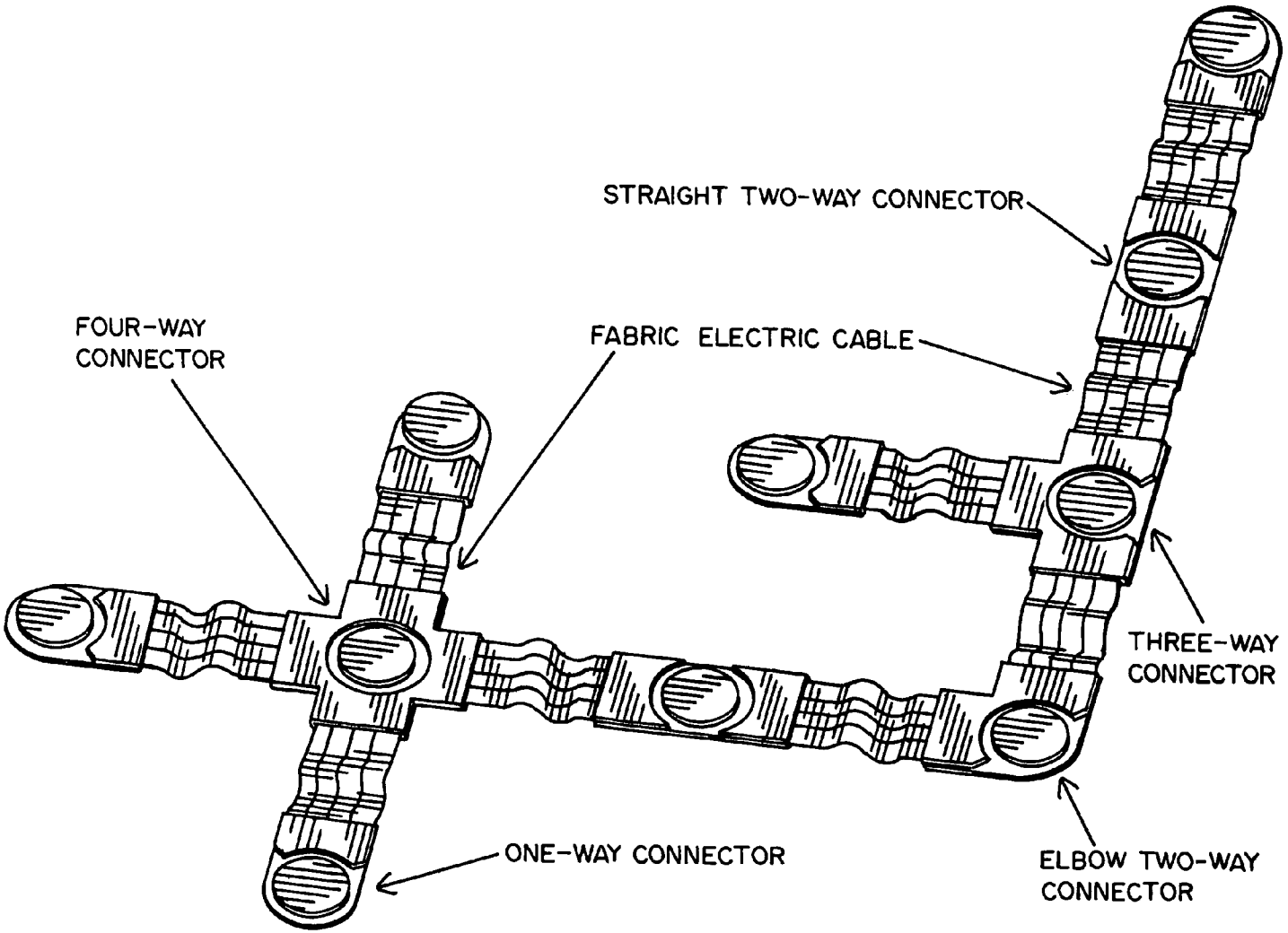
FIG. 12 is an illustration of various possible connector configurations using the present invention.
Figure 13:
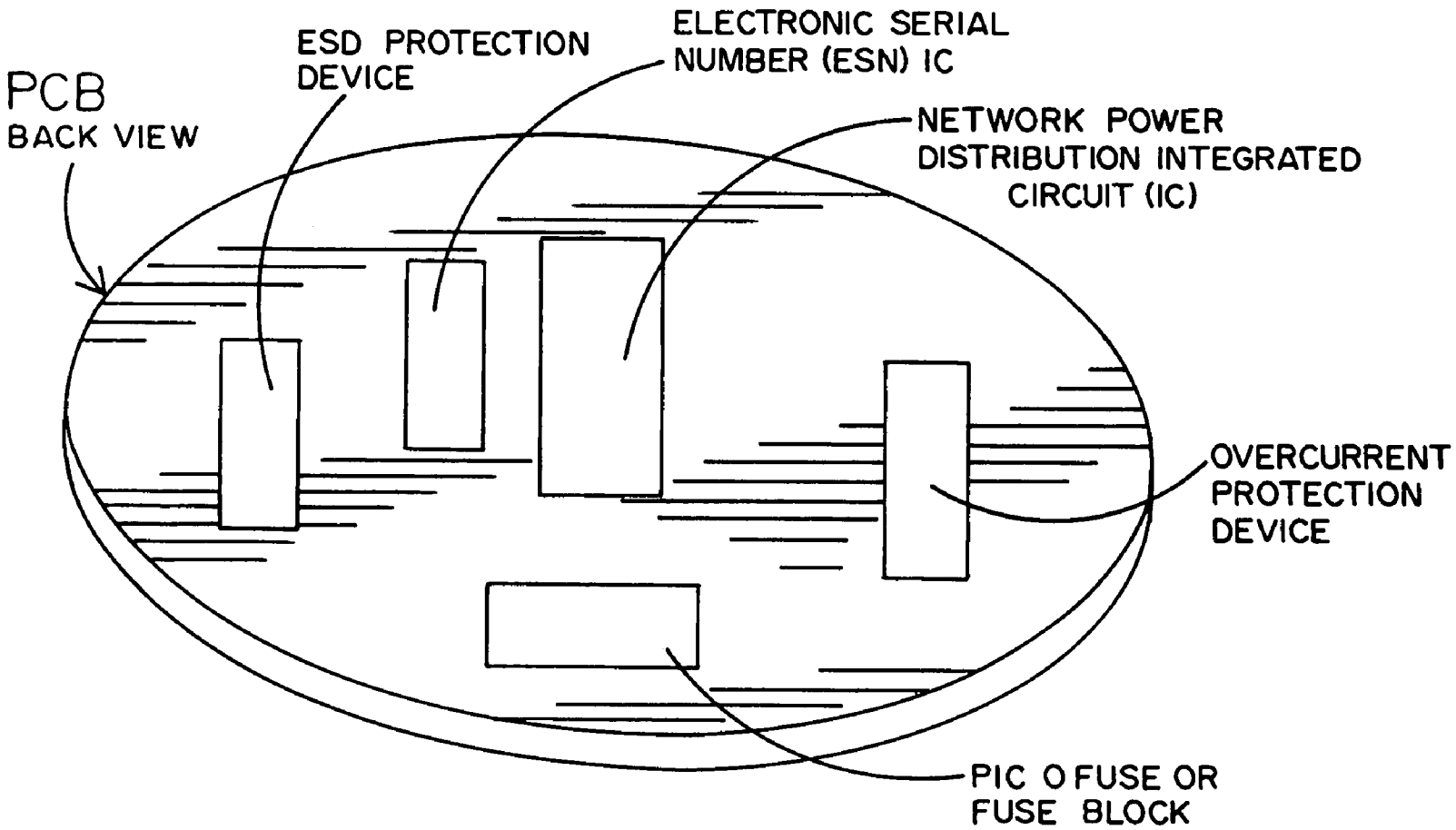
FIG. 13 is an illustration of a connector printed circuit board (PCB) having such features as an electronic serial number integrated circuit to uniquely identify the connector.

The invention's power and data network is formed by integrating wearable connectors and e-textile cabling. This new network can be dynamically reconfigured by daisy chaining individual snap connectors with e-textile cable segments (see FIG. 12).

A network can be detached easily (from the garment) because each wearable connector can be attached only by snaps rather than being permanently affixed. Some of the major advantages of this removable arrangement are:

- Existing garments can be retrofitted without major redesign.
- The location is no longer limited to the vest; for example, it can be on pants.
- The design affords unlimited function-oriented reconfigurability.
- It can be completely removed from the garment:
  - For laundering
  - For shipment
  - For repair.

General fabrication methodology comprises the following basic steps:

- Each snap connector is attached to the end of a piece of fabric with enclosed electric cable.
- Reflow soldering bonds the circuits to the contact pads on each PCB, and strain relief secures the cable to the connector.
- The inventive connector's conductive rubber gasket is manufactured by conventional mechanical die punch technology.
- The fasteners and torsion springs are purchased as off-the-shelf items in quantities sufficient to keep costs low.
- The snap connector PCBs are made by established fabrication houses that ensure cost effective production with fast turnaround.
- The eyelet and strain relief covers for both the female and male snap connectors are injection molded.
- Both the socket (male connector) and stud (female connector) are produced by metal injection molding.
- Metal injection molding applies plastic injection molding techniques to economically produce complex shapes, yet delivers the near-full density and properties of standard steels and other alloys.

Figure 16:
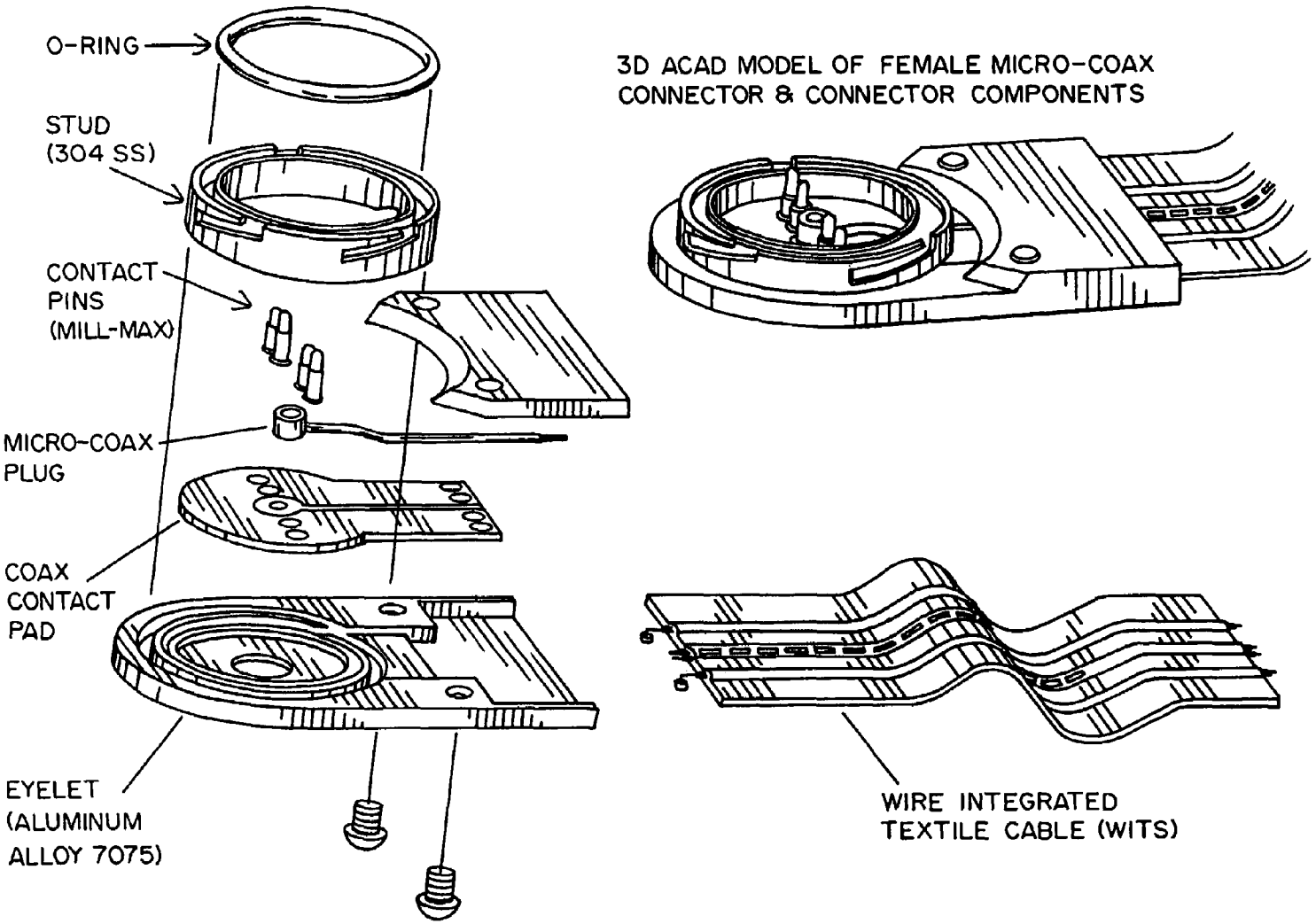
FIG. 16 is an illustration of a wearable connector embodiment having a micro-coax plug for high bandwidth signals.

FIG. 16 illustrates an alternative connector embodiment comprising at least one coaxial connection for high bandwidth applications. The female portion is shown in FIG. 16 to include a coax PCB which accommodates a coax plug as well as a plurality of contact pins. The corresponding male portion has a mating coax plug in addition to a PCB having conductive paths to engage the pins. In all other respects, the connector of FIG. 16 is consistent with the connector of FIGS. 6 and 7.

Figure 17:
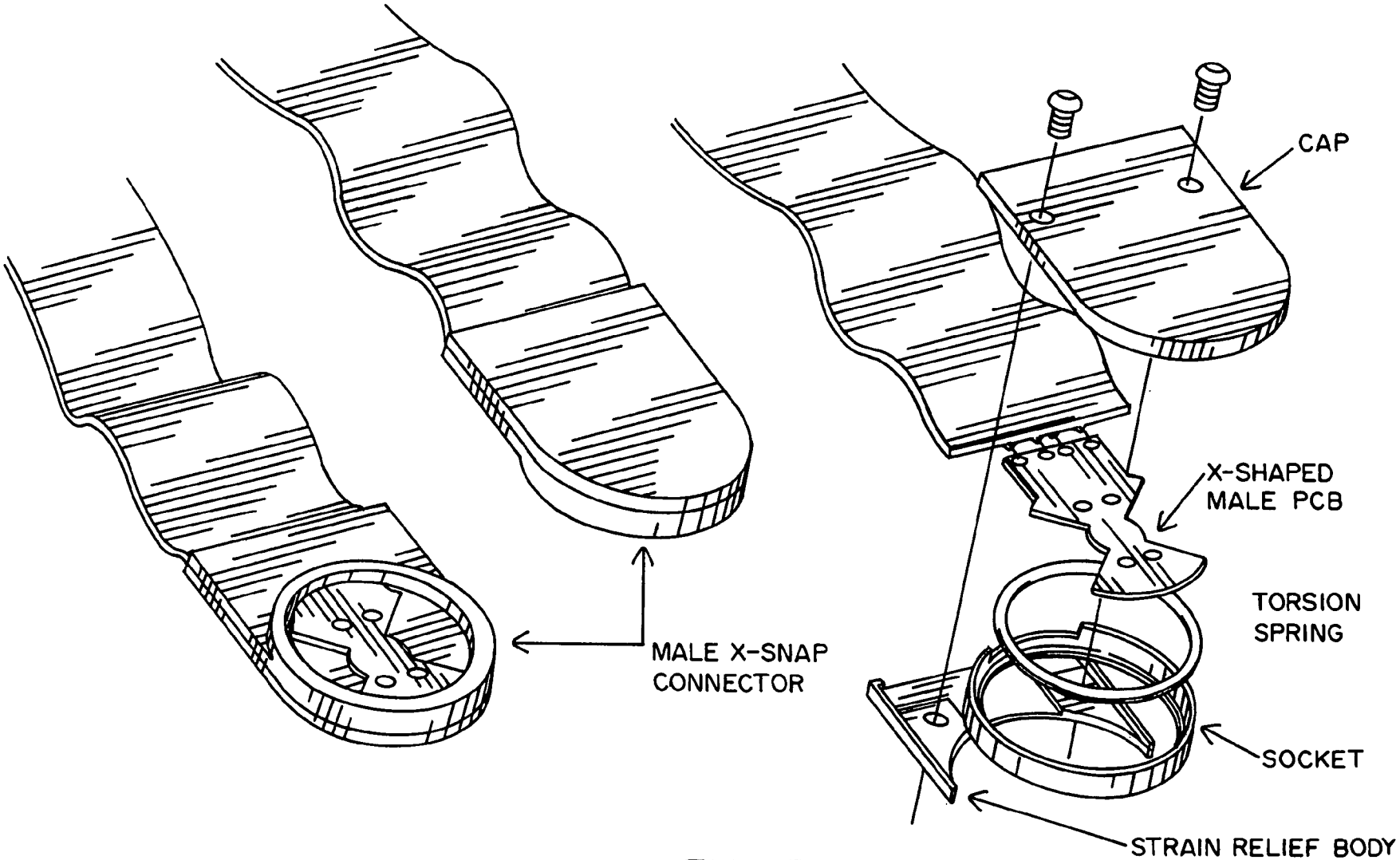
FIGS. 17-19 are illustrations of a wearable connector having an X-SNAP pin sealing feature.
Figure 18:
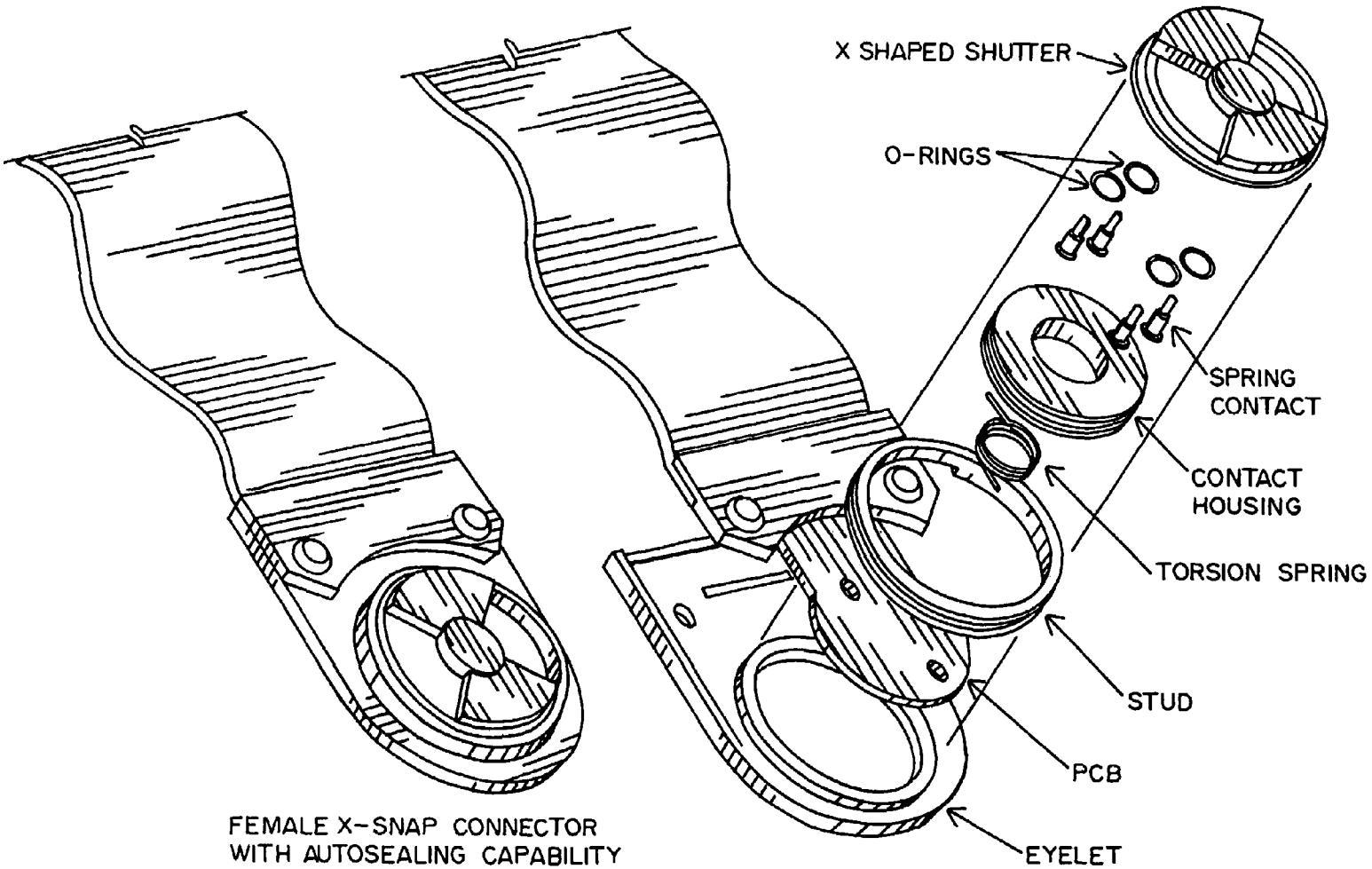
Figure 19:
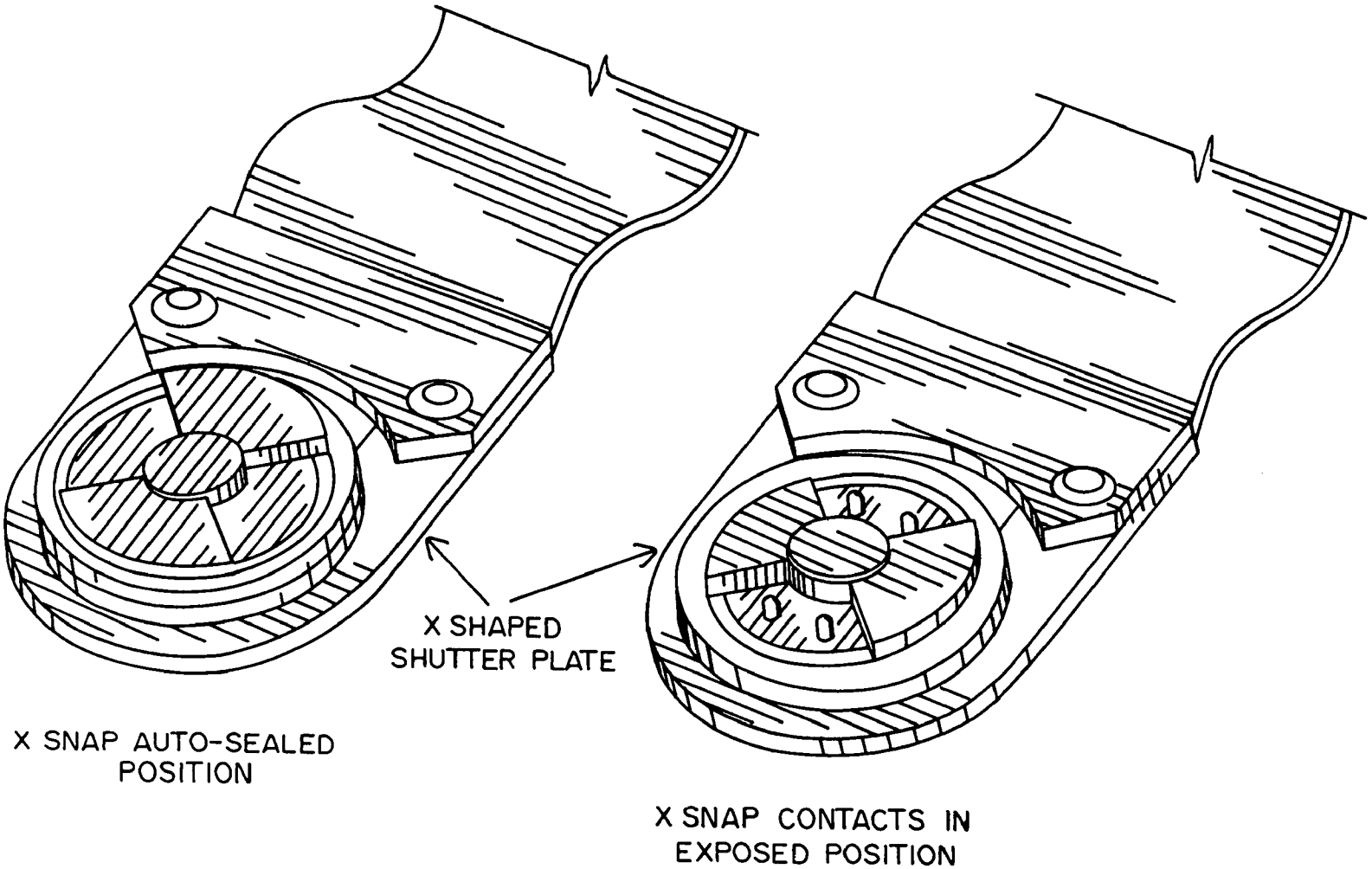
Figure 20:
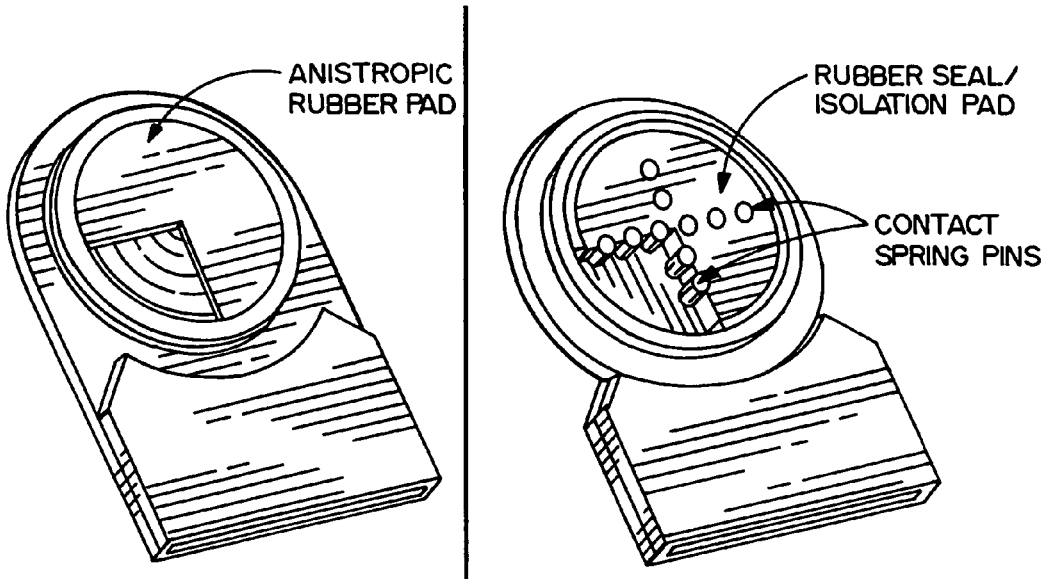
FIGS. 20-22 are illustrations of an alternative pin sealing technique using a curable silicone rubber compound.
Figure 21:
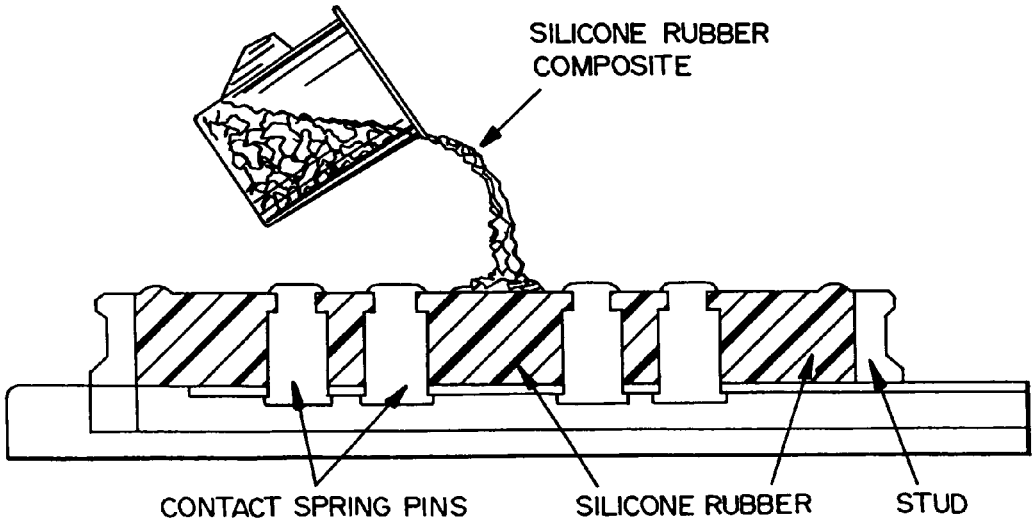
Figure 22B:
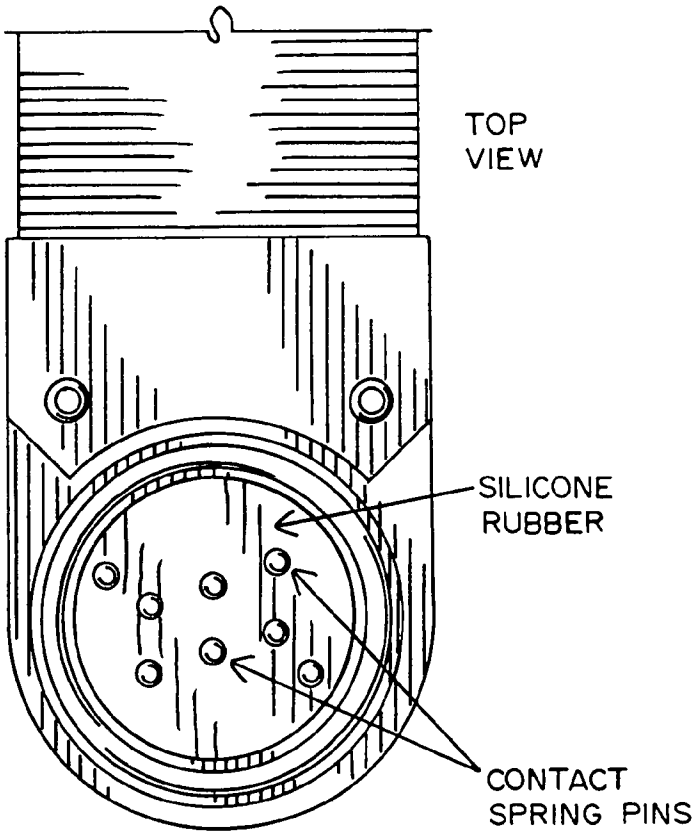
Figure 22A:
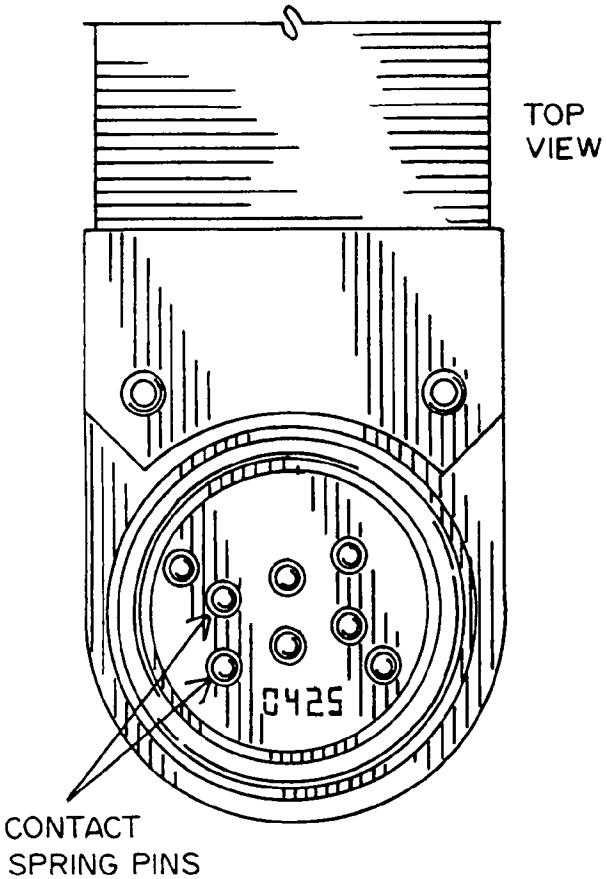
Figure 22C:
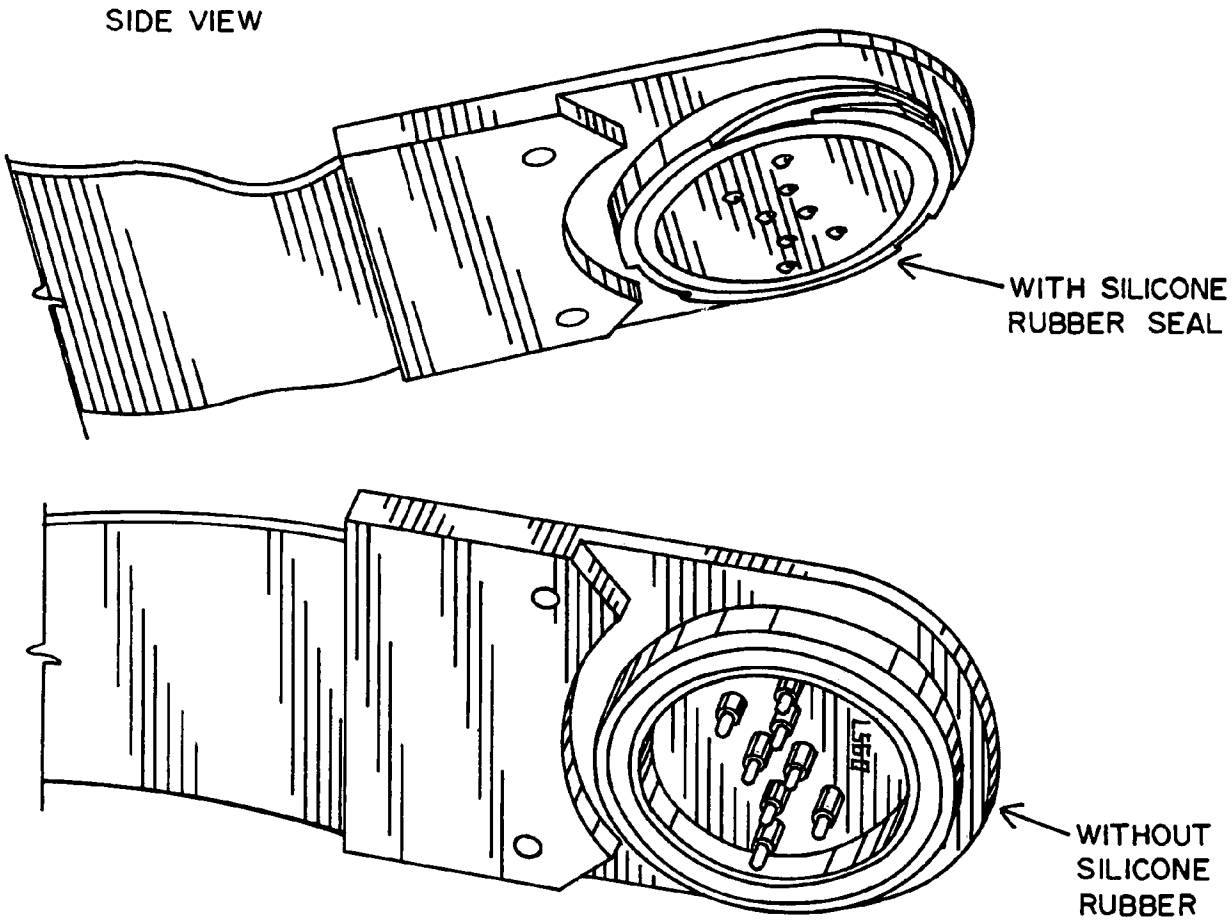

FIGS. 17 through 22 illustrate alternative embodiments for sealing connector components against the environment. FIGS. 17 to 19 show the use of an X-shaped shutter and attendant torsion spring in the female portion and an X-shaped shutter and attendant torsion spring in the female portion and an X-shaped PCB in the male portion. When the mating portions are demated, the torsion spring causes the shutter plate to automatically rotate into a position which seals the pin contacts in the female portion to prevent their contamination. FIGS. 20 to 22 illustrate another pin sealing technique. A silicone rubber compound is poured in a liquid state into the stud of the female portion up to the top of the pins and cured into a hardened state leaving only the axial ends of the pins exposed as shown in FIG. 21 and in FIG. 22. The silicon rubber can be shaped so that a flap is formed above the axial end of each pin which seals the end when the connector is demated, but permits the ends to extend through the flaps when the connector is mated.

Figure 23:
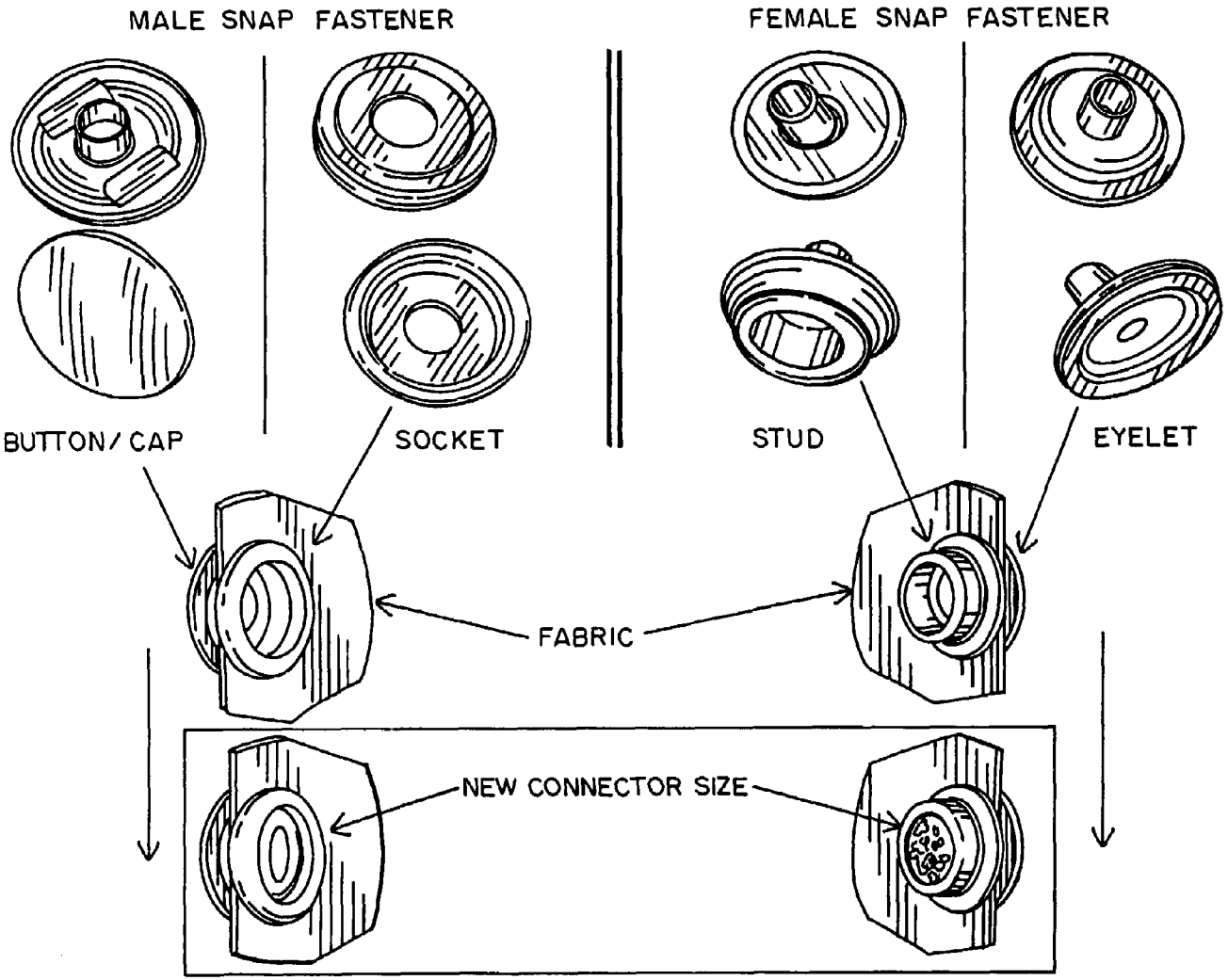
FIGS. 23-25 illustrate a wearable connector that is the size of a conventional snap fastener commonly used on clothing.
Figure 24:
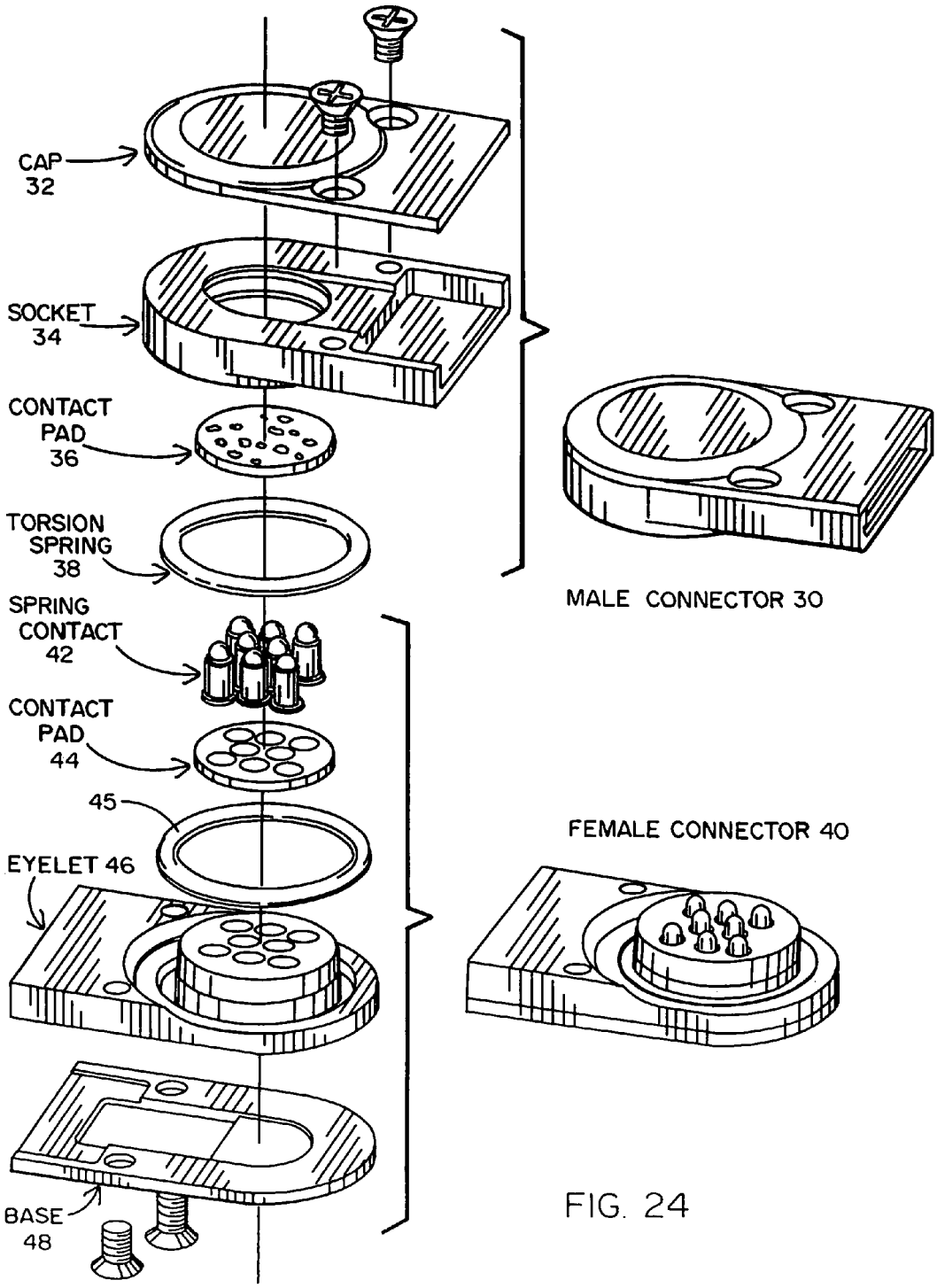
Figure 25:
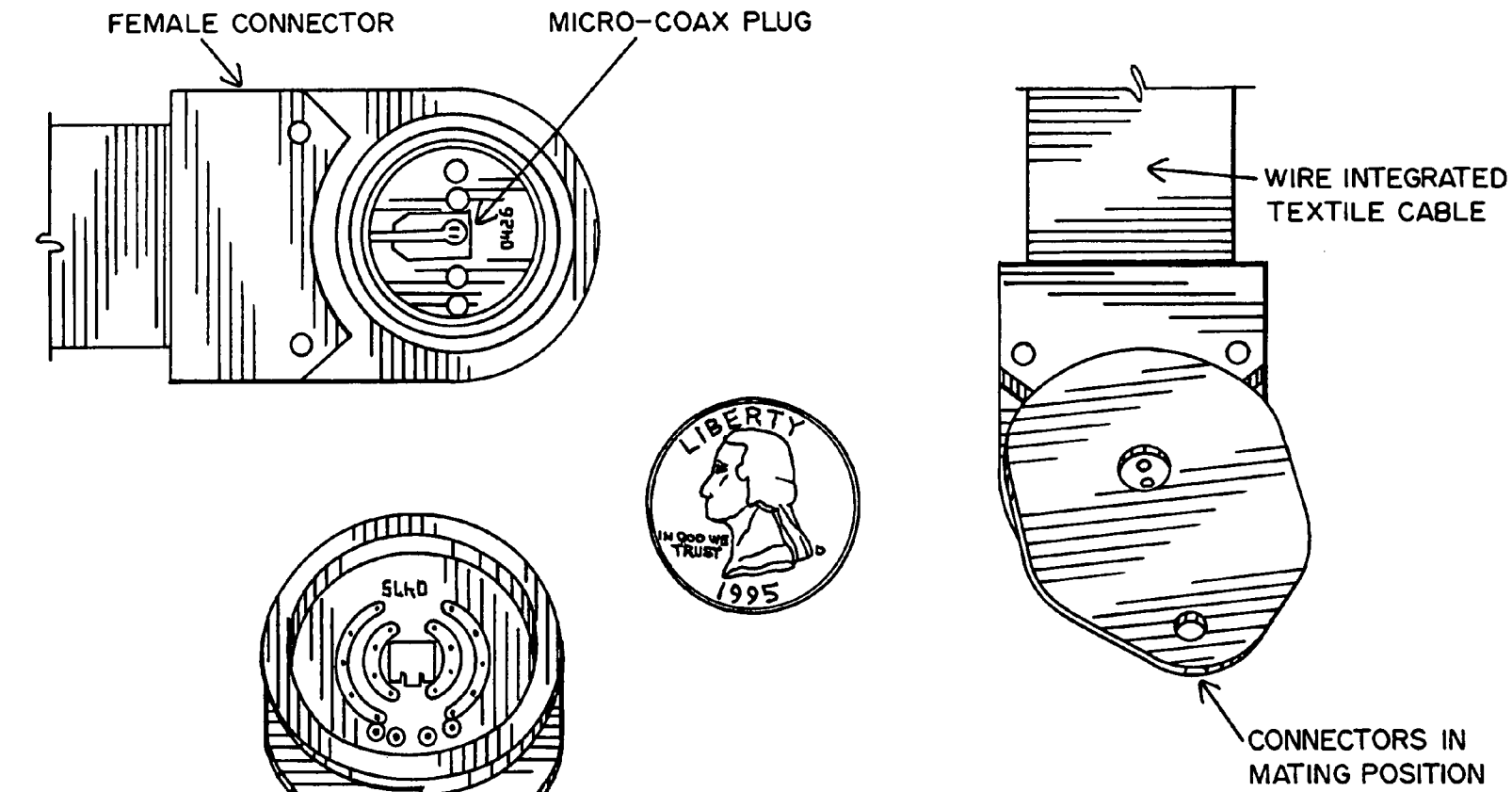

FIGS. 23 to 25 illustrate the fifth version of the invention, which is the smallest wearable connector currently developed. As seen in FIG. 25, this embodiment (even with a center coax plug) is a little greater in diameter than the diameter of a U.S. dime. It is configured to have the same appearance, tactile feel and function of a conventional fabric snap fastener as shown in FIG. 23. FIG. 24 illustrates the individual components of the male 30 and female 40 connector of this fifth embodiment, namely, caps 32, socket 34, contact pad 36, torsion spring 38, spring contacts 42, contact pad 44, torsion spring 45, eyelet 46 and base 48.

Figure 26:
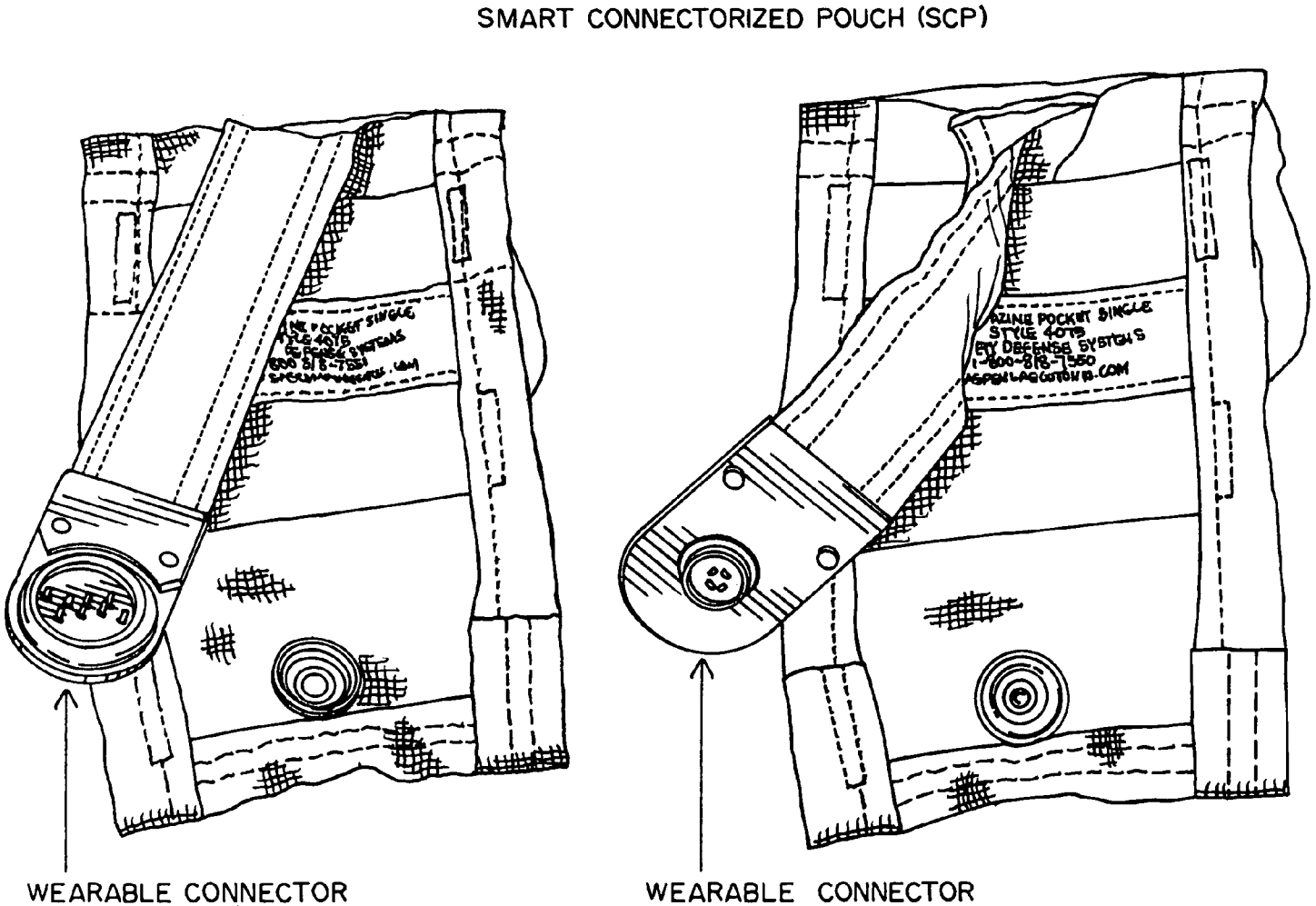
FIG. 26 illustrates a pouch having a wearable connector therein.

FIG. 26 shows a Smart Connectorized Pouch. The garment pouch is suitably sized for receiving an electronic device and having a wearable connector at the end of a short length of fabric ribbon within the pouch. The connector attaches to the device held in the pouch thereby providing both electrical interface and mechanical support. In some cases, where the electrical device has a proprietary connector, an intermediate cable (universal interface) can be provided with appropriate wire and signal protocol interfaces to convert the type of connection.

Figure 27:
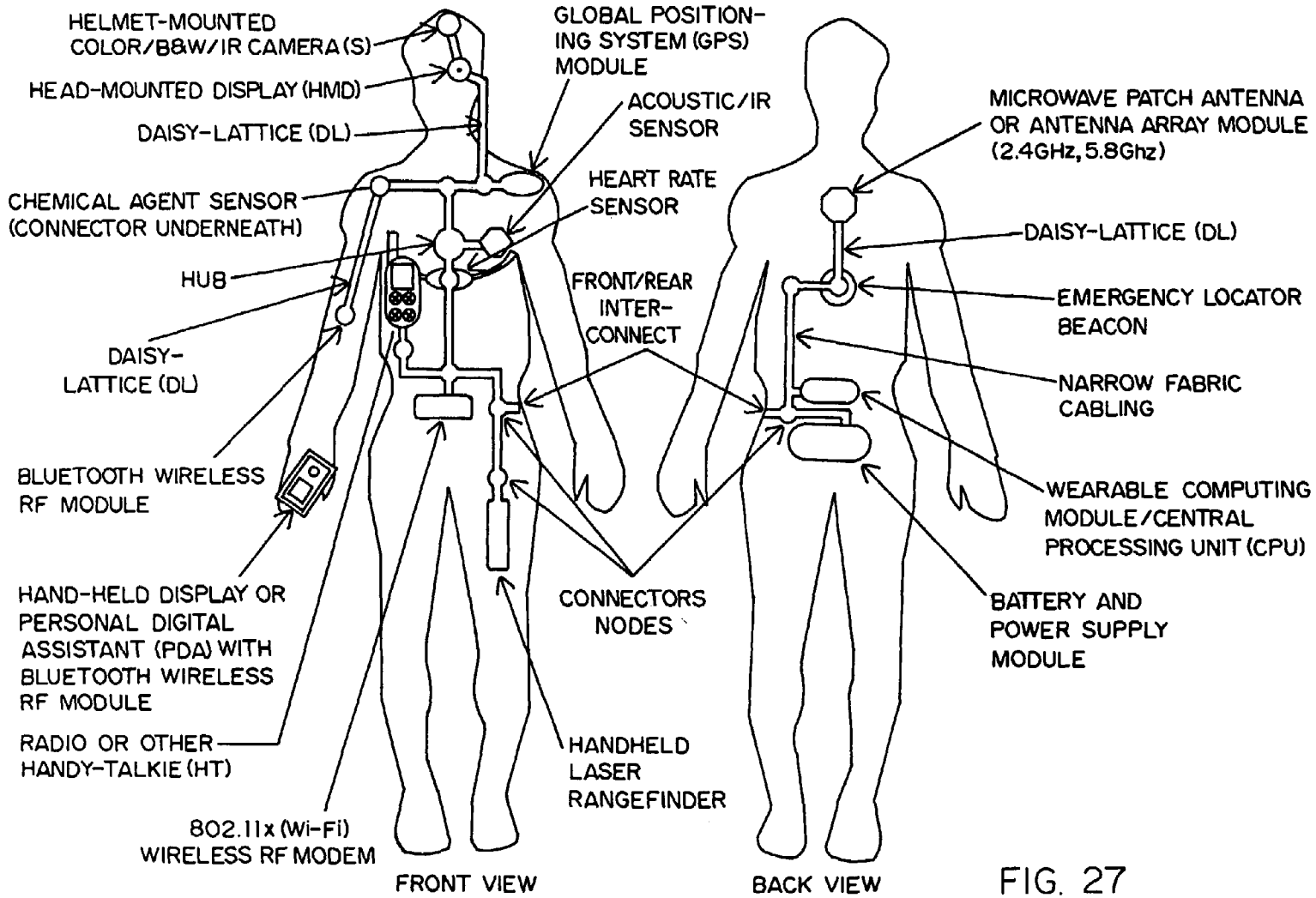
FIG. 27 is a schematic drawing of a full body network facilitated by the wearable connector of the invention.

FIG. 27 is a schematic illustration of front and rear views of a typical full body network using wearable connectors and conductive paths to integrate a variety of components. Included devices in this illustrative example are a GPS system, camera, CPU, battery and power supply, locator beacon, antenna, head-mounted display, chemical agent sensor, wireless transceiver, PDA, radio, modem, laser rangefinder, heart rate sensor, infrared sensor, directional locating device, acoustic sensor and haptic feedback actuator.

Carton Security Embodiment

Figure 28:
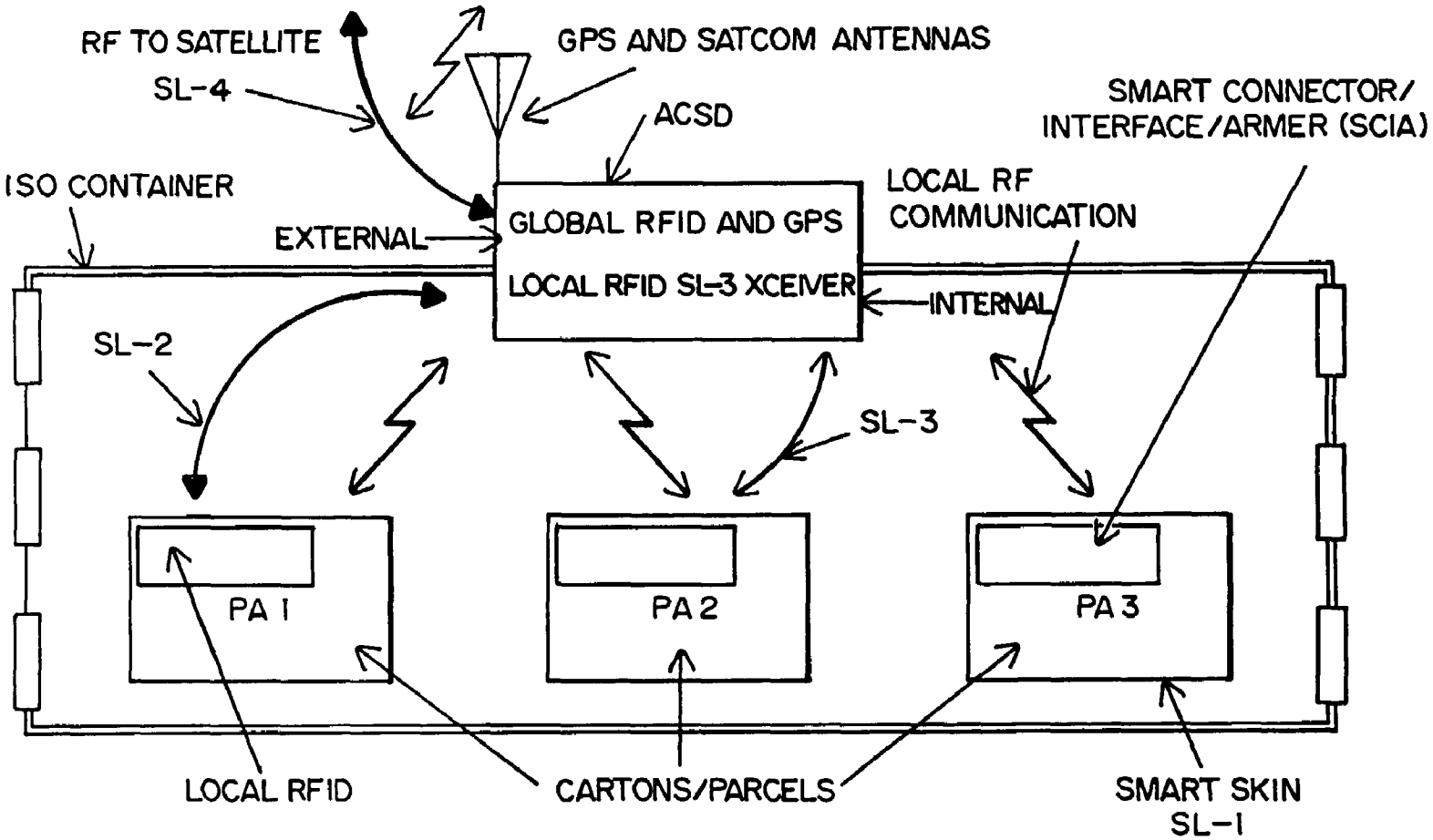
FIG. 28 is a schematic representation of the architectural relationships among four security layers relating to the carton-centric embodiment of the invention.

A "carton-centric" system, called Secure Parcel ISO Distributed Enhanced RFID (SPIDER), will enhance the Advanced Container Security Device and radio frequency identification (ACSD and RFID tag) technologies and can be retrofitted to existing shipping cartons and/or parcels, including those consisting of boxboard or corrugated cardboard, and is flexible enough to be integrated with all future secure shipping carton technologies. FIG. 28 illustrates the architectural relationships among the proposed security layers—SL-1, SL-2, SL-3, and SL-4. We see that the physical skin arming and monitoring intra-carton SL-1 is entirely all-carton-centric.

The Turn-key Alarm and Reporting System (TARS) SL-2 is RFID/ACSD-compatible, including local communication between carton RFID tags and the ISO container ACSD. It is inter-carton and intra-ACSD, for one-bit alarming within the ACSD in the event of either disarming or tampering with the carton. The removal or destruction of the TARS electronics will be detected and indicated with an alarm by the ISO container's RFID/ACSD system, as will disarming the SL-2 itself, irrespective of whether or not the disarming was authorized. After this, the system can be rearmed and used again. The SL-2 TARS will be packaged within a unique Smart Connector/Interface/Armor (SCIA), based on the above disclosed wearable connector technology. It can be integrated with carton-based RFIDs.

The major advantage of the SPIDER system is that its smart skin, or SL-1, is implanted inside the carton body, in an integrated and concealed way (see FIG. 29), and is easy to mass-produce. The smart skin consists of a thin five-layer sandwich: a protective outer layer, a layer imprinted with parallel conductive ink traces, an insulating layer, a layer imprinted with conductive ink traces perpendicular to those in the second layer, and a final inner protective layer. This is in contrast to the wires in the security systems of Wal-Mart, Target, and others, which must be mechanically damaged to sound an alarm. When the SPIDER web (skin) is damaged even slightly (by breaking a single path, which is unavoidable in even slight tampering, similar to tearing cloth); the SL-1 sets off what is, in effect, a silent alarm.

Figure 29:
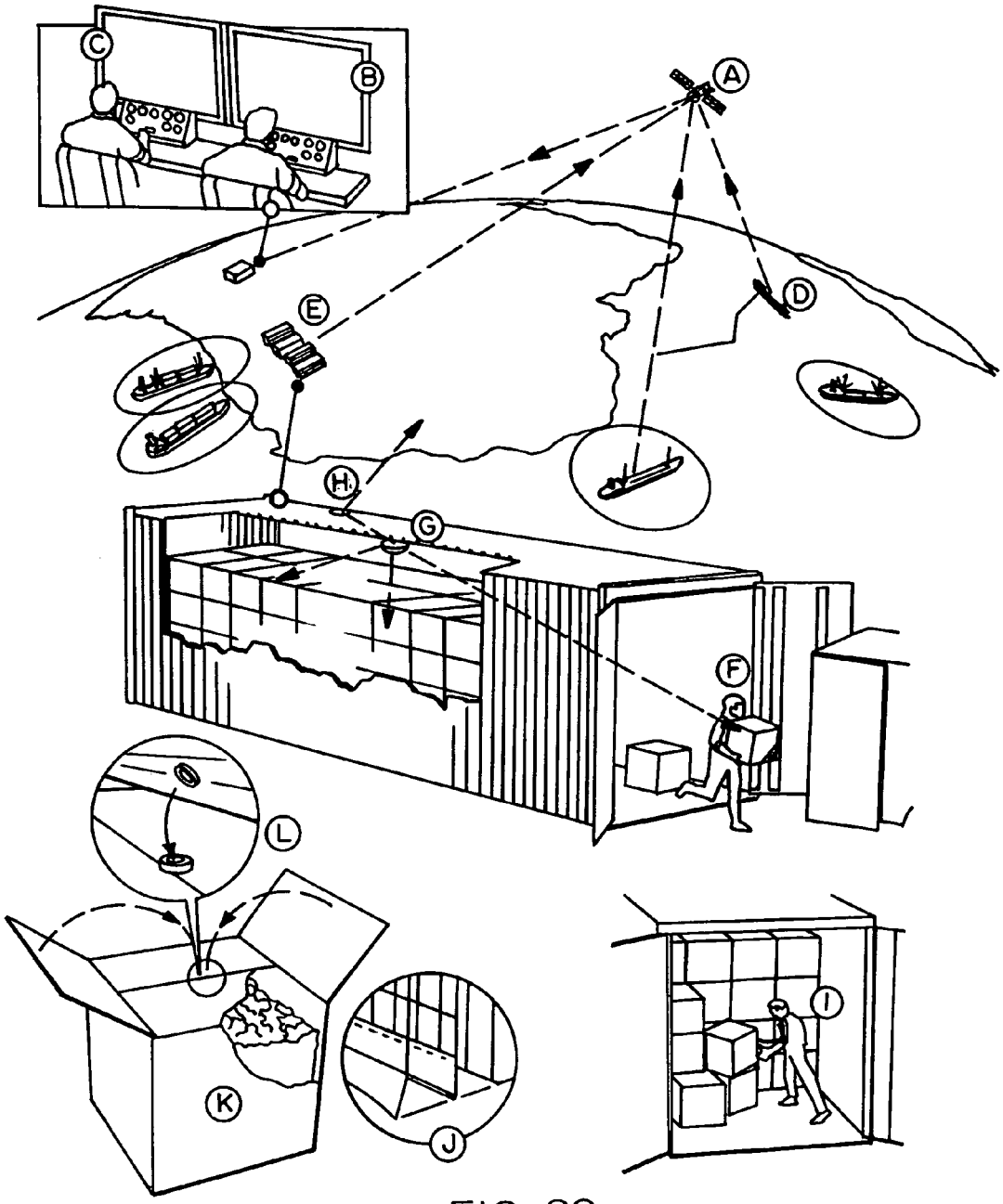
FIG. 29 illustrates the various security layers of FIG. 28 including the SPIDER carton body of the invention.

The SPIDER carton-centric security system uniquely combines a low-cost version of ruggedized inventive connector technology; and a novel carton security system arming/monitoring/local communication RF electronics. The SPIDER system is depicted in FIG. 29. The SPIDER system will fully meet the homeland security need to autonomously seal, secure, and monitor the integrity of shipping cartons/parcels below the ISO intermodal shipping container level. The SPIDER system will seal the contents of a shipping carton within a "smart skin/wrapper," which physically surrounds the contents, monitors the physical integrity of the shipping carton and detects any intrusion into the carton, providing notification of violation of the carton or tampering with the SPIDER security system, including alteration (addition/subtraction/replacement) of the carton contents, or even theft or unauthorized removal of the entire carton (or addition of an unauthorized one) being monitored/protected by SPIDER. The SPIDER system will ensure complete end-to-end shipping carton/parcel integrity verification, with no specialized knowledge or training required of any of the shipping and receiving personnel (i.e. "turn-key" activation/arming and monitoring). Any penetration of the SPIDER smart skin/wrapper or tampering with the TARS electronics (including the embedded RFID technology) will be immediately detected and indicated by the security violation alarm latched into the TARS electronics in a tamperproof fashion. The RFID scanner to interrogate the TARS and report carton status can be located outside the ISO shipping container (e.g., handheld, loading dock mounted, truck mounted).

The SPIDER smart skin carton-lining subsystem will be fabricated from thin sheets of slightly elastomeric plastic material as a substrate to support a two-dimensional (2D) matrix of electrically resistive conductive ink "wires", forming an "electrical cage" around the carton's contents. This electrically active part will be surrounded on both sides by a thin dielectric layer to protect against the environment. This 2D smart matrix subsystem will be fabricated in two versions: flexible (as "e-paper"), and rigid (as "e-boxboard"), to protect both cartons and parcels. The "smart skin" matrix will be monitored by electronics, which will be embedded in the inventive snap-fastener connector, which can be operated blind and single-handed, and will be used to close the loop of the smart skin electrical cage around the carton's contents, engage and arm the TARS alarm system, and report the carton's integrity to an ACSD or to an external RFID scanner via an electronic one-bit-alarm system (SL-2) embedded into the TARS connector. For detection of tampering, the smart skin 2D net will be constructed of <5 mm square cells forming a 2D matrix of conductive ink paths (CIPs), with 1-3 mil (75 μm)×500 μm rectangular cross sections. The CIP material is carbon-derivative with controlled density, so that the specific resistance can be adjusted to tune the 1 μW total power consumption with 5 s pulses; this enables the system to operate on low-cost minibatteries within the connector, which resembles a small button (~118 mm in diameter) or a clothing snap-fastener.

It should be emphasized that typical electrical resistive wires are unsuitable because of their poor mechanical stability and low smart skin conformability. The CIP approach used in SPIDER does not share these deficiencies and instead has the following unique advantages: a) High mechanical stability; b) Tunable electrical resistivity; c) "Binary" response; d) Transmittivity under X-ray inspection (if needed); and e) High mass-productability.

While the first two advantages are rather apparent, the third, explained in detail hereinafter, is due to the fact that unless the CIP is completely broken, its resistance preserves nearly its original value. Therefore, the electrical response to a CIP breaking is almost binary. So a precise Wheatstone electrical bridge circuit ensures the sensitivity and stability to the TARS sensing electronics. The fourth advantage is due to the fact that the CIP carbon derivatives are virtually transparent to X-rays, in contrast to most metallic compounds. The fifth advantage is due to well-established low-cost mass-production web-imprinting for fabrication of the SPIDER smart skin.

Figure 30B:
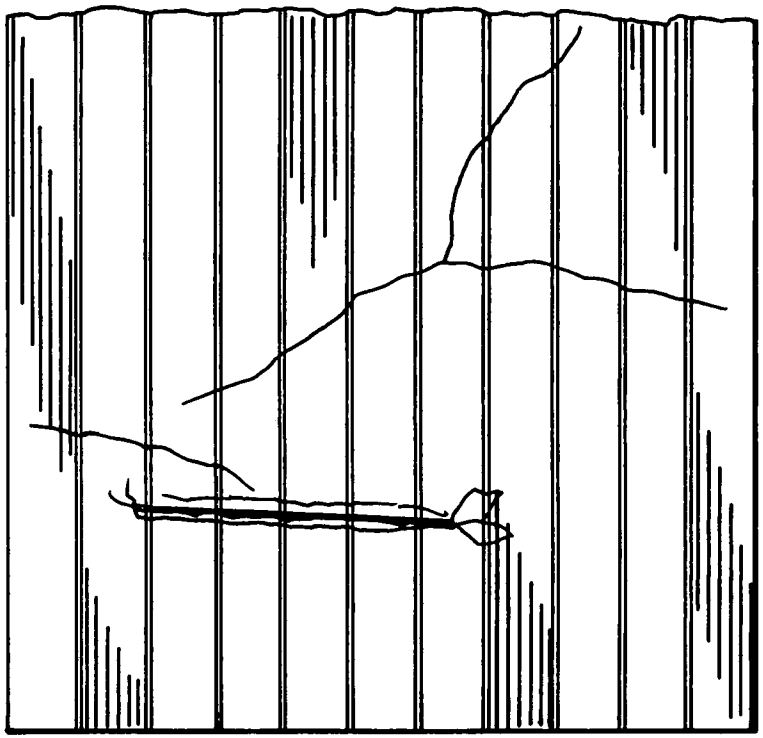
FIG. 30, comprising FIGS. 30(*a*) and 30(*b*), shows photographs of a carton skin undamaged and damaged, respectively, with a conductive ink skin network.
Figure 30A:
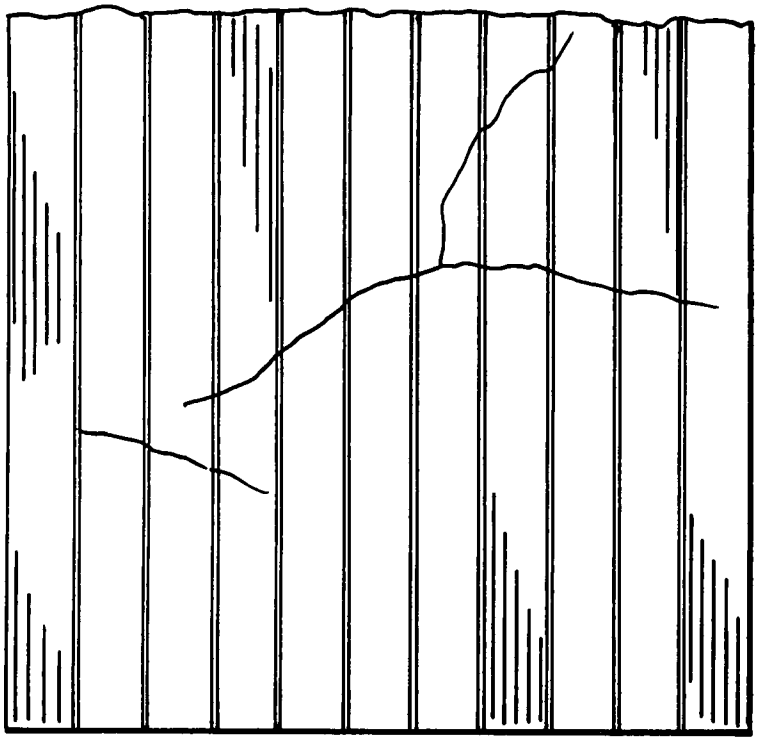

The printed electrical cage (PEC) (See FIG. 30) is a critical aspect of SPIDER, protecting the carton against tampering. It consists of a square network of conductive paths, with very low baseline electrical currents that would be altered by tampering. This 2D net consists of two sandwiched nets. Consider one such 1D SPIDER net. It consists of a parallel set of uniformly distributed resistive paths, fabricated from carbon-based conductive ink paths (CIP). Consider such a CIP in the form of a rectangular-cross-section-bar, with length (L=1 m), height (h=75 μm), and width (W=500 μm), illustrated in FIG. 31. Such a path is only 3 mil (75 μm) high, because it is web-imprinted on a slightly elastic substrate for good stickiness. The process is similar to web-press printing, where the height of the ink is also quite low.

Figure 31:
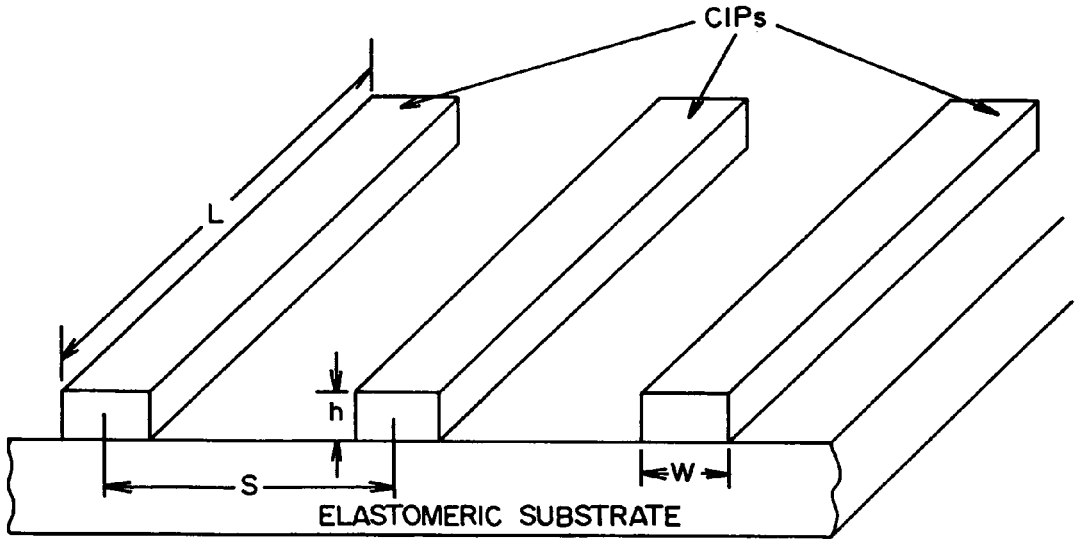
FIG. 31 is a schematic diagram of the conductive ink paths (CIPs)

From FIG. 31, we have $R_0=\rho L/hw$, where L=1 m, h=75 μm, and w=500 μm, while ρ is tuned to satisfy the electrical balance conditions; where ρ is resistivity, or specific resistance, in Ωm. It is not easily achievable by other techniques such as metal wires. FIG. 31 is not to scale because: L>>w>>h. In our case, we assume s=5 mm (it can be smaller if needed), and 200 CIPs cover the 1 m×1 m area.

The conductive path is also from conductive ink, but with much higher material density. In the case of 1D SPIDER net, the total resistance $R_x$, is $1/R_x=n/R_0$, or $R_x=R_0/n$, where n=200, and total power consumption of a single CIP is assumed to be 1 μW to minimize power consumption; thus, for v=1 V, $$P_x = \frac{u^2}{R_x}, \quad \text{and } R_x = \frac{u^2}{P_x} = \frac{(1V)^2}{1\,\text{m}\Omega} = 10^6\Omega.$$

Thus, the specific resistance of the CIP, or its resistivity in Ωm, is $1.875\times10^{-3}$ Ω which is five orders of magnitude higher than that of copper (for which $\rho_o$ $0^{-8}$ m). Therefore, the tunability of CIP resistivity is very high, an extremely useful feature to minimize SPIDER power consumption, and maximize system sensitivity.

The major challenge for the PEC (Printed Electrical Cage) design is to minimize power consumption, and at the same time to maximize PEC sensitivity to tampering. For PEC purposes, the minimum tampering is breaking a single CIP, which will create the minimum current change ΔI. The total 1D PEC current $I_x$, is $nI_o$, where $I_o=u_o^2/R_o$, and n=200, with $u_o$=1V. Thus, ΔI is substituting by (n−1) for (n), leading to: $\Delta I=I_o=\sqrt{P_o/R_o}$, where $P_o$=1 μW, and $R_o=10^6\Omega$; thus, $\Delta I=10^{-6}$ A, which is a reasonable value easy to achieve with a Wheatstone bridge as discussed below.

The electrical power consumption is also very low because the PEC signals are in 1 ms 200 μW pulses, with an energy of $2\times10^{-7}$ J, generated in 1 s periods (i.e., with a 1/1000 duty cycle). Since a year consists of ~315 million seconds, the total time of such pulses is 315,000 seconds per year, which yields only a 126 mWs energy consumption per year for two 1D SPIDER nets forming a single 1 m×1 m 2D SPIDER net, which is extremely low power consumption even for mini-batteries (typical value: 100 mWh).

The SPIDER binary response is a rather unexpected feature for the CIP and PEC. This is because tampering reduces the CIP cross section by damaging the CIP, while the $R_o$ value remains almost unchanged. To show this, consider a partially damaged CIP as in FIG. 32.

Figures 32A, 32B, 32C:
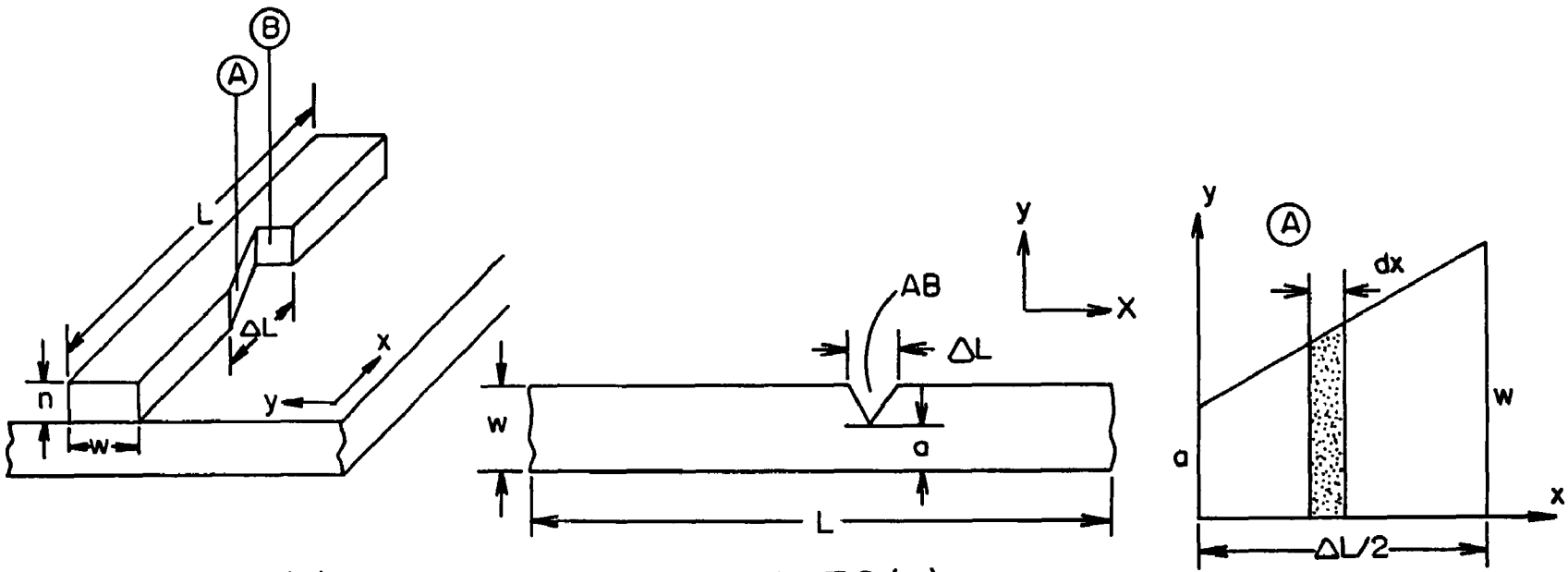
FIG. 32, comprising FIGS. 32(*a*), 32(*b*) and 32(*c*), shows a damaged CIP including (a) an overview, (b) top view, and (c) differential element.

According to FIG. 32(*c*), the resistance change in the damaged part A or B (A and B are identical) $\Delta R_o$ is $$\Delta R_O = \frac{\rho_x}{h}\int_0^{\Delta L/2}\frac{dx}{y} = \frac{\rho_x(\Delta L/2)}{h(w-a)}\ell n\left(\frac{w}{a}\right)$$

where y=z=((w−a)/(ΔL/2)) x+a and ln ( . . . ) is natural logarithm. Since $$R_O = \frac{(\rho_x \times L)}{(w\times h)},$$

the relative resistance charge for both A and B is, for a<<w, equal to $$(\Delta L/L)\ell n\left(\frac{w}{a}\right).$$

Assume that $(\Delta L/L)=10^{-3}$, for L=1 m and ΔL=1 mm. Then, in order to achieve a the relative resistance change comparable with 0.1, the logarithm must be of the order of 100, which is possible only for extremely high (w/a) ratios. For example, for $(w/a)=10^9$, the ln $10^9$ is only 21. Therefore, we conclude that unless the CIP is completely broken, its damaged resistance value is equal to $R_o$. This confirms the binary response of the CIP under tampering, which is a very useful feature for the SPIDER net, since the CIP resistance values are very tolerant of partial damage caused by careless packaging, poorly controlled fabrication, etc.

Figure 33:
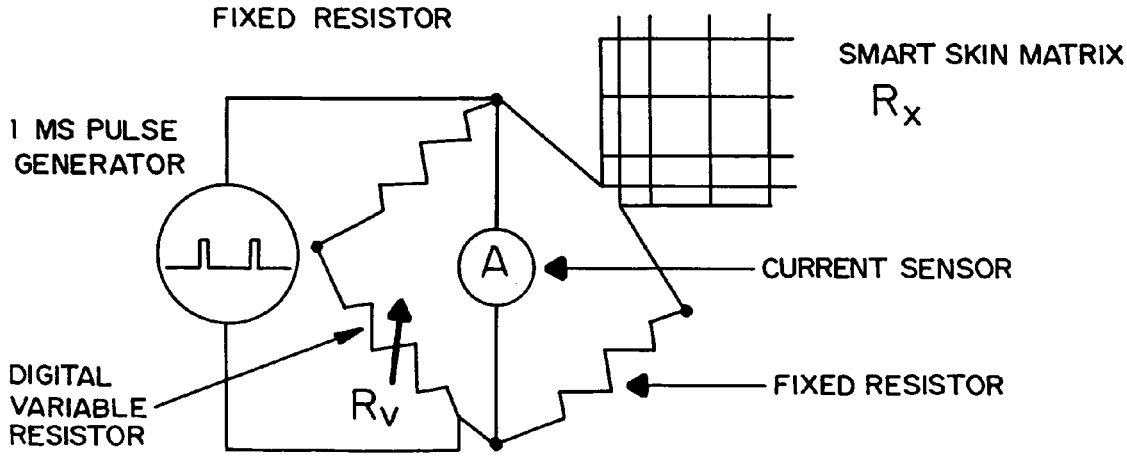
FIG. 33 is a schematic drawing of a Wheatstone bridge configuration used for smart skin monitoring.

The SPIDER connector will close the circuit, arming the PEC system. This single-hand operable low-cost blind connector is specially configured for SPIDER purposes, including such components as two SPIDER Wheatstone bridges, a miniature battery, latching storage for alarm recording, and RFIDs to send a binary alarm signal to the container RFID. The SPIDER connector will have the form factor of a coin 1 cm in diameter and 3 mm in height, connected into the 2D SPIDER PEC net. Since the Wheatstone bridge balance condition is $R_1R_3=R_2R_4$, we assume the particular case: $R_1=R_2=R_3=R_4=R_x$, where $R_x$ is the resistance of an undamaged 1D SPIDER net (FIG. 33). Then for the balanced bridge case, the total resistance R is equal to $R_X$, and the power consumption of the bridge is four times that of the PEC, or 800 μW; i.e., still very low because of the low duty-cycle electrical pulse voltage supply.

All of the SPIDER electronics except for the smart skin will be housed inside the electrical snap connector.

This snap connector functions as both the mechanical closure and the electrical arming mechanism. For SL-1 security, the increase in the total resistance of the smart-skin is measured by means of a sensitive "proportional balance" electronic circuit known as a Wheatstone bridge, as illustrated in FIG. 33.

This measurement configuration will enable the SPIDER to detect even small changes in the total resistance of the smart-skin with enough sensitivity to detect even a single violated trace in the smart-skin matrix. This is accomplished by placing the digital equivalent of a galvanometer across the bridge circuit, which is balanced (nulled) at the time of arming the SPIDER-protected carton (after it has been filled at the point of origin) by setting digital potentiometers to the values necessary to establish zero voltage across the middle of the bridge. After arming/balancing, any change in the resistance of the smart-skin will unbalance the Wheatstone bridge and produce a measurable voltage across the digital galvanometer, thereby activating an alarm condition, indicating that the smart-skin (and therefore the carton being protected) has been violated.

Level SL-2 security includes an RFID chip, the smart-skin sensing electronics, the alarm activation electronics, anti-static protection circuitry, the RFID interface electronics, and a button-cell battery such as an Eveready CR-1025. The electronics to perform this will be provided as an application-specific integrated circuit (ASIC) (or FPGA). The working prototype will use discrete surface-mount components and commercial off-the-shelf ASICs such as the S2C hybrid ASIC from CYPAK in. Sweden, which includes a 13.56 MHz RFID interface on board the ASIC. ASICs such as these can be mounted "naked" for low component profile (0.25 mm) and low "real estate" (~1.0 $cm^2$) on the SPIDER smart connector PCB—and can operate from −200 to +400 C.

For SL-3 security protection, SPIDER's "delay generator" and associated communications electronics will also be in the snap connector. Inside the body of the snap connector is a printed circuit board (PCB), which can be fabricated from standard FR-4 PCB material or from flexible PCB materials. All electronic components plus the terminals from the smart-skin matrix will be soldered to this PCB. The "cap" and "base" snap connector pieces, which form the snap connector housing, will be formed of RF-transparent materials so as not to interfere with operation of the RFID subsystem, possibly even using this surface area to print an RFID antenna in conductive ink. These pieces can be made by injection-molding at extremely low cost.

Low-cost manufacturing by injection molding and wave soldering will mean that the SPIDER electronics can be discarded with the shipping carton after unpacking. Recovery operations for recycling the SPIDER electronics could also be employed for environmental reasons.

The flexible, slightly elastomeric substrate base for the smart-skin is available on >300 ft. rolls as a film, and can be imprinted with the conductive ink traces by web-printing. For example, PET polyester is a durable yet biodegradable substrate at a tenth the cost of polyamide, and can be processed into the SPIDER smart-skin in this fashion. PET has very good dielectric properties, and has low moisture absorption, making it ideal for use in shipping containers. As rolls of the raw substrate enter the web press, controlled amounts of high-resistance carbon-based conductive ink are deposited at regular intervals across the width of the substrate by pneumatic dispensers and set by pressure rollers. As the substrate proceeds from the supply drum to the take-up drum, evenly-spaced lines of conductive ink are formed along the length of the substrate. Laminating two such sections of imprinted film substrate, with one of them rotated 90 degrees, forms the crosshatch smart-skin matrix.

Having thus disclosed preferred embodiments of the present invention, it will now be apparent that the illustrated examples may be readily modified without deviating from the inventive concepts presented herein. By way of example, the precise shape, dimensions and layout of the connectors and connector pins may be altered while still achieving the function and performance of a wearable smart electrical connector. Accordingly, the scope hereof is to be limited only by the appended claims and their equivalents.

We claim:

1. A wearable electrical connector for use on a garment having a body conformable communication network, the connector comprising:

a first mating element configured to be secured to a first garment portion;

a second mating element configured to be secured to a second garment portion, the second mating element configured to be releasably fastened with the first mating element;

a printed circuit board disposed at least partially within the first mating element, the printed circuit board having a plurality of electrically conductive signal traces configured to be electrically coupled to electrical conducting paths of the body conformable network in the first garment portion;

electrically conductive contact pins, oriented along a mating axis of the first and second mating elements and disposed at least partially within the second mating element, the contact pins configured to be electrically coupled to electrical conducting paths of the body conformable network in the second garment portion, and the contact pins being positioned such that the plurality of contact pins make electrical contact with corresponding conductive signal traces on the printed circuit board when the first mating element is fastened to the second mating element, wherein the conductive signal traces and contact pins are disposed within their respective mating elements in a manner so as to allow mating of the first and second mating elements with freedom of rotation of the mating elements about the mating axis and wherein, when the first mating element is fastened to the second mating element, the first and second mating elements releasably secure the first garment portion to the second garment portion and, the contact pins make electrical contact with the conductive signal traces on the printed circuit board so as to electrically couple electrical signal paths in the first garment portion to electrical signal paths in the second garment portion.

2. The wearable electrical connector of claim 1, wherein the conductive traces on the printed circuit board comprise a plurality of concentric annular conducting paths, and wherein individual ones of the concentric annular conducting paths is configured to make electrical contact with respective ones of the contact pins when the first mating element is fastened to the second mating element.

3. The wearable electrical connector of claim 2, wherein the concentric annular conducting paths are 360 degree annular rings concentrically surrounding a central axis, such that the first and second connector portions can be mated to join the first and second garment portions and to connect the electrical signal paths in the first and second garment portions with 360 degree freedom of rotation about the central axis.

4. The wearable electrical connector of claim 2, wherein the concentric annular conducting paths comprises a plurality of discontinuous annular arcuate paths concentrically surrounding a central axis, such that the first and second connector portions, when in a first orientation about the central axis an electrically conductive pin of the second element contacts a first arcuate path, and when in a second orientation about the central axis the same electrically conductive pin of the second element contacts a second arcuate path, thereby allowing the wearable connector to also function as a switch.

5. The wearable electrical connector of claim 1, wherein the first and second mating elements are configured to be riveted or sewn to their respective first and second garment portions.

6. The wearable electrical connector of claim 1, wherein the first and second mating elements are configured to join the first and second garment portions and to connect the electrical signal paths in the first and second garment portions with freedom of rotation about the central axis.

7. The wearable electrical connector of claim 1, further comprising a seal disposed in a cavity of the first or second mating element.

8. The wearable electrical connector of claim 7, wherein the seal is an O-ring seal disposed in a gland of the first or second mating element and configured to be compressed when the first mating element is fastened to the second mating element.

9. The wearable electrical connector of claim 7, wherein the seal is a conductive elastomer-based sealant configured to provide a seal when the first and second mating elements are unmated and when they are mated.

10. The wearable electrical connector of claim 1, wherein the body conforming network further comprises a wearable electrical cable.

11. The wearable electrical connector of claim 1, wherein the wearable connector is RFI and EMI shielded when the first mating element is fastened to the second mating element.

12. The wearable electrical connector of claim 1, further comprising a torsion spring disposed within the first or second mating element.

13. The wearable electrical connector of claim 1, wherein the first and second mating elements comprise mating elements configured as garment snap fasteners.

14. The wearable electrical connector of claim 1, wherein the first and second mating elements comprise garment snap fasteners, thereby allowing one-handed closure.

15. The wearable electrical connector of claim 1, further comprising a coaxial plug disposed at the center of the printed circuit board.

16. The wearable electrical connector of claim 1, wherein the printed circuit board further comprises electrical traces configured to connect to a plurality of electrical signal paths of the body conformable communication network in the first garment portion.

17. The wearable electrical connector of claim 1, wherein the printed circuit board further comprises electrical traces configured to interconnect a plurality of electrical signal paths of the body conformable communication network together.

18. The wearable electrical connector of claim 1, wherein the first or second mating elements comprise an eyelet and a stud to fasten the element to its respective garment portion.

19. The wearable electrical connector of claim 1, further comprising a strain relief connected to the first or second element.

20. A wearable electrical connector for use on a garment having a body conformable communication network, the connector comprising:

a first mating element configured to be secured to a first garment portion;

a second mating element configured to be secured to a second garment portion, the second mating element configured to be releasably fastened with the first mating element;

a printed circuit board disposed at least partially within the first mating element, the printed circuit board having a plurality of electrically conductive signal traces disposed on a surface of the printed circuit board in a pattern of concentric 360 degree annular rings about a central axis, the signal traces configured to be electrically coupled to electrical conducting paths of the body conformable network in the first garment portion;

electrically conductive contact pins disposed at least partially within the second mating element, the contact pins configured to be electrically coupled to electrical conducting paths of the body conformable network in the second garment portion, and the contact pins being positioned such that the contact pins make electrical contact with corresponding conductive signal traces on the printed circuit board when the first mating element is fastened to the second mating element;

wherein, when the first mating element is fastened to the second mating element, the first and second mating elements releasably secure the first garment portion to the second garment portion and, the contact pins make electrical contact with the conductive annular rings on the printed circuit board so as to electrically couple electrical signal paths in the first garment portion to electrical signal paths in the second garment portion and to allow 360 degree freedom of rotation about the central axis.

21. The wearable electrical connector of claim 20, wherein the first and second mating elements are configured to be riveted or sewn to their respective first and second garment portions.

22. The wearable electrical connector of claim 20, wherein the first and second mating elements comprise mating elements configured as garment snap fasteners.

23. The wearable electrical connector of claim 20, wherein the first and second mating elements comprise garment snap fasteners, thereby allowing one-handed closure.

24. The wearable electrical connector of claim 20, wherein the first and second mating elements comprise garment snap fasteners thereby allowing blind mating of the first and second mating elements.

25. The wearable electrical connector of claim 20, further comprising a coaxial plug disposed at the center of the printed circuit board.

* * * * *

UNITED STATES PATENT AND TRADEMARK OFFICE

CERTIFICATE OF CORRECTION

PATENT NO. : 7,462,035 B2
APPLICATION NO. : 11/190697
DATED : December 9, 2008
INVENTOR(S) : Kang Lee et al.

It is certified that error appears in the above-identified patent and that said Letters Patent is hereby corrected as shown below:

Replace the Government Interest section, starting at col. 1, line 6 and ending at col. 1, line 9, with the following:

The invention described herein was made with Government support under contract W911QY-04-0038 awarded by the U.S.A. Soldier Systems Center in which the Government has certain rights in the invention.

Signed and Sealed this

Twenty-fourth Day of February, 2009

JOHN DOLL
*Acting Director of the United States Patent and Trademark Office*